US010982842B2

(12) United States Patent
Fulkerson et al.

(10) Patent No.: US 10,982,842 B2
(45) **Date of Patent: *Apr. 20, 2021**

(54) RETROFIT LIGHT ASSEMBLY AND POWDER SPRAY GUN WITH INTEGRATED OR RETROFIT LIGHT

(71) Applicant: NORDSON CORPORATION, Westlake, OH (US)

(72) Inventors: Terrence M. Fulkerson, Brunswick, OH (US); Brian D. Mather, North Ridgeville, OH (US); Jared J. Bell, Lakewood, OH (US); Michael Thomas, Grafton, OH (US); Jeffery A. Perkins, Amherst, OH (US); John A. Greco, Brunswick, OH (US); Thomas Loparo, Wellington, OH (US); Stephen P. Lovass, Bratenahl, OH (US); Gregory S. Dawson, Niceville, FL (US); John Palazzo, Medina, OH (US); Martin T. Vicens, Clemmons, NC (US); John J. Binder, Amherst, OH (US); Jeffery Dailidas, The Villages, FL (US); James Khoury, Strongsville, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/714,991

(22) Filed: Dec. 16, 2019

(65) Prior Publication Data

US 2020/0191377 A1 Jun. 18, 2020

Related U.S. Application Data

(63) Continuation of application No. 15/927,550, filed on Mar. 21, 2018, now Pat. No. 10,539,318.

(Continued)

(51) Int. Cl.
*F21V 33/00* (2006.01)
*B05B 15/00* (2018.01)

(Continued)

(52) U.S. Cl.
CPC ..... *F21V 33/0084* (2013.01); *B05B 5/025* (2013.01); *B05B 5/043* (2013.01);

(Continued)

(58) Field of Classification Search
CPC .. F21V 33/0084; F21V 17/002; F21V 23/003; F21V 23/04; B05B 5/025;

(Continued)

(56) References Cited

U.S. PATENT DOCUMENTS 5,341,989 A * 8/1994 Fulkerson ..... B05B 5/032 239/3
5,725,161 A * 3/1998 Hartle ..... B05B 5/053 118/629

(Continued)

FOREIGN PATENT DOCUMENTS

CN 2192124 Y 3/1995
CN 201132146 Y 10/2008

(Continued)

OTHER PUBLICATIONS

ISA/220—Notification of Transmittal of Search Report and Written Opinion of the ISA, or the Declaration dated May 30, 2018 for WO Application No. PCT/US18/023546.

*Primary Examiner* — Mary Ellen Bowman
(74) *Attorney, Agent, or Firm* — BakerHostetler

(57) ABSTRACT

A light assembly coupled to a spray gun for spraying electrostatically charged coating material is disclosed. The spray gun includes a gun body comprising a barrel, a nozzle assembly extending from the barrel in a longitudinal direction, a voltage multiplier, and an actuator assembly config- (Continued)

ured to transition the voltage multiplier between an activated state and a deactivated state. The light assembly includes a light and circuitry electrically connected to the light. The circuitry is configured to supply electrical energy inductively obtained by the circuitry to the light when the voltage multiplier is in the activated state. The light assembly can also include a housing, a lens cover releasably attached to the housing, and a control member for changing a characteristic of the light.

17 Claims, 24 Drawing Sheets

Related U.S. Application Data

(60) Provisional application No. 62/474,580, filed on Mar. 21, 217.

(51) Int. Cl.

| | |
|---|---|
| ***F21V 17/00*** | (2006.01) |
| ***F21V 23/00*** | (2015.01) |
| ***F21V 23/04*** | (2006.01) |
| ***F21S 9/02*** | (2006.01) |
| ***B05B 5/043*** | (2006.01) |
| ***B05B 5/025*** | (2006.01) |
| ***B05B 5/053*** | (2006.01) |

(52) U.S. Cl.
CPC ..... *B05B 5/053* (2013.01); *B05B 15/00* (2013.01); *F21S 9/02* (2013.01); *F21V 17/002* (2013.01); *F21V 23/003* (2013.01); *F21V 23/04* (2013.01)

(58) Field of Classification Search
CPC ..... B05B 5/043; B05B 5/053; B05B 15/00; F21S 9/02
See application file for complete search history.

(56) References Cited

U.S. PATENT DOCUMENTS

| | | | | |
|---|---|---|---|---|
| 9,409,196 | B1 | 8/2016 | Lucas | |
| 2002/0131267 | A1* | 9/2002 | Van Osenbruggen | B23Q 17/2404 362/109 |
| 2007/0159819 | A1* | 7/2007 | Bayat | F21L 4/02 362/236 |
| 2017/0089555 | A1 | 3/2017 | Honeycutt, III | |
| 2017/0173607 | A1* | 6/2017 | Wright | B05B 5/03 |
| 2017/0291181 | A1* | 10/2017 | Wright | A61L 2/14 |
| 2018/0317627 | A1* | 11/2018 | Fukuda | B05B 12/004 |
| 2019/0060922 | A1* | 2/2019 | Wright | B05B 5/1675 |

FOREIGN PATENT DOCUMENTS

| | | | |
|---|---|---|---|
| CN | 202012840 | U | 10/2011 |
| CN | 104754844 | A | 7/2015 |
| CN | 204986802 | U | 1/2016 |
| CN | 205217185 | U | 5/2016 |
| DE | 4203989 | | 8/1993 |

* cited by examiner

RETROFIT LIGHT ASSEMBLY AND POWDER SPRAY GUN WITH INTEGRATED OR RETROFIT LIGHT

CROSS REFERENCE TO RELATED APPLICATIONS

This application is a continuation of U.S. patent application Ser. No. 15/927,550, filed Mar. 21, 2018, which claims the benefit of U.S. Provisional Patent App. No. 62/474,580, filed Mar. 21, 2017, the teachings of both of which are hereby incorporated by reference as if set forth in their entireties herein.

TECHNICAL FIELD

This disclosure generally relates to light assemblies, and more particularly relates to material application devices, for example spray guns, including attached light assemblies.

BACKGROUND

A material application device, such as a spray gun, is used to apply a coating material to an object, part, or other work piece or surface. The coating material can be a liquid, a powder, or other material as required, and can be electrostatically charged by the spray gun. Using electrostatically charged coating materials can have many benefits. For example, the use of electrostatically charged coating materials limits over-spray, as coating material particles that do not contact the work piece will be drawn to the work piece due to the electrostatic charge. This aids in eliminating wasted coating material, thus cutting costs.

During operation of the spray gun, which may be manually operated, a user may need to periodically cease using the spray gun and visually inspect the work piece to ensure that the work piece has been sufficiently coated. Due to the fine nature of some coating materials, or ambient conditions in which spraying occurs, such as low lighting, the amount or consistency of coating material applied to the work piece may not be readily apparent to the user without external illumination. To inspect the work piece, the user often needs to employ the use of a light, such as an LED light, to illuminate the work area. However, conventional lights add to the number of tools required for a coating operation and require connection to external power sources.

Therefore, there is a need for a light assembly that is capable of attaching to spray guns and does not require a physical connection to external power sources.

SUMMARY

A spray gun for spraying electrostatically charged coating material is disclosed. The spray gun includes a gun body comprising a barrel, a nozzle assembly extending from the barrel in a longitudinal direction, a voltage multiplier, and an actuator assembly configured to transition the voltage multiplier between an activated state and a deactivated state. The spray gun includes a light assembly coupled to the gun body, the light assembly including a light and circuitry electrically connected to the light. The circuitry is configured to supply electrical energy inductively obtained by the circuitry to the light when the voltage multiplier is in the activated state.

Another embodiment of the present invention is a light assembly configured to be coupled to a spray gun for spraying electrostatically charged coating material, where the spray gun includes a voltage multiplier transitionable between an activated state, in which the voltage multiplier produced a magnetic field, and a deactivated state, where the voltage multiplier does not produce the magnetic field. The light assembly includes a housing, a light attached to the housing, and circuitry contained within the housing, the circuitry being electrically connected to the light and configured to supply electrical energy inductively obtained by the circuitry to the light.

A further embodiment of the present disclosure is a spray gun for spraying electrostatically charged coating material. The spray gun includes a gun body comprising a barrel, a nozzle assembly extending from the barrel in a longitudinal direction, a voltage multiplier, and an actuator assembly configured to transition the voltage multiplier between an activated state and a deactivated state. The spray gun also includes a light assembly coupled to the gun body, the light assembly including a housing, a light, and circuitry electrically connected to the light, as well as a lens cover releasably attached to the housing to change the characteristics of the light that is emitted from the light assembly.

An embodiment of the present disclosure is a manually held spray gun for spraying electrostatically charged coating material. The spray gun includes a gun body comprising a barrel, a nozzle assembly extending from the barrel in a longitudinal direction, a voltage multiplier, and a trigger assembly to control the spraying of the electrostatically charged coating material from the spray gun. The spray gun also includes a light assembly coupled to the gun body, the light assembly including a light and circuitry electrically connected to the light, as well as a control member on the gun for changing a characteristic of the light emitted by the light assembly.

An additional embodiment of the present disclosure is a spray gun for spraying electrostatically charged coating material. The spray gun includes a gun body comprising a barrel, a nozzle assembly extending from the barrel in a longitudinal direction, a voltage multiplier, and an actuator assembly to control the spraying of coating material from the gun. The spray gun also includes a light assembly coupled to the gun body, the light assembly including a light and circuitry electrically connected to the light, wherein the light assembly is contained in a housing, where there are no electrical connectors passing through the wall of the housing.

BRIEF DESCRIPTION OF THE DRAWINGS

The foregoing summary, as well as the following detailed description, will be better understood when read in conjunction with the appended drawings. The drawings show illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
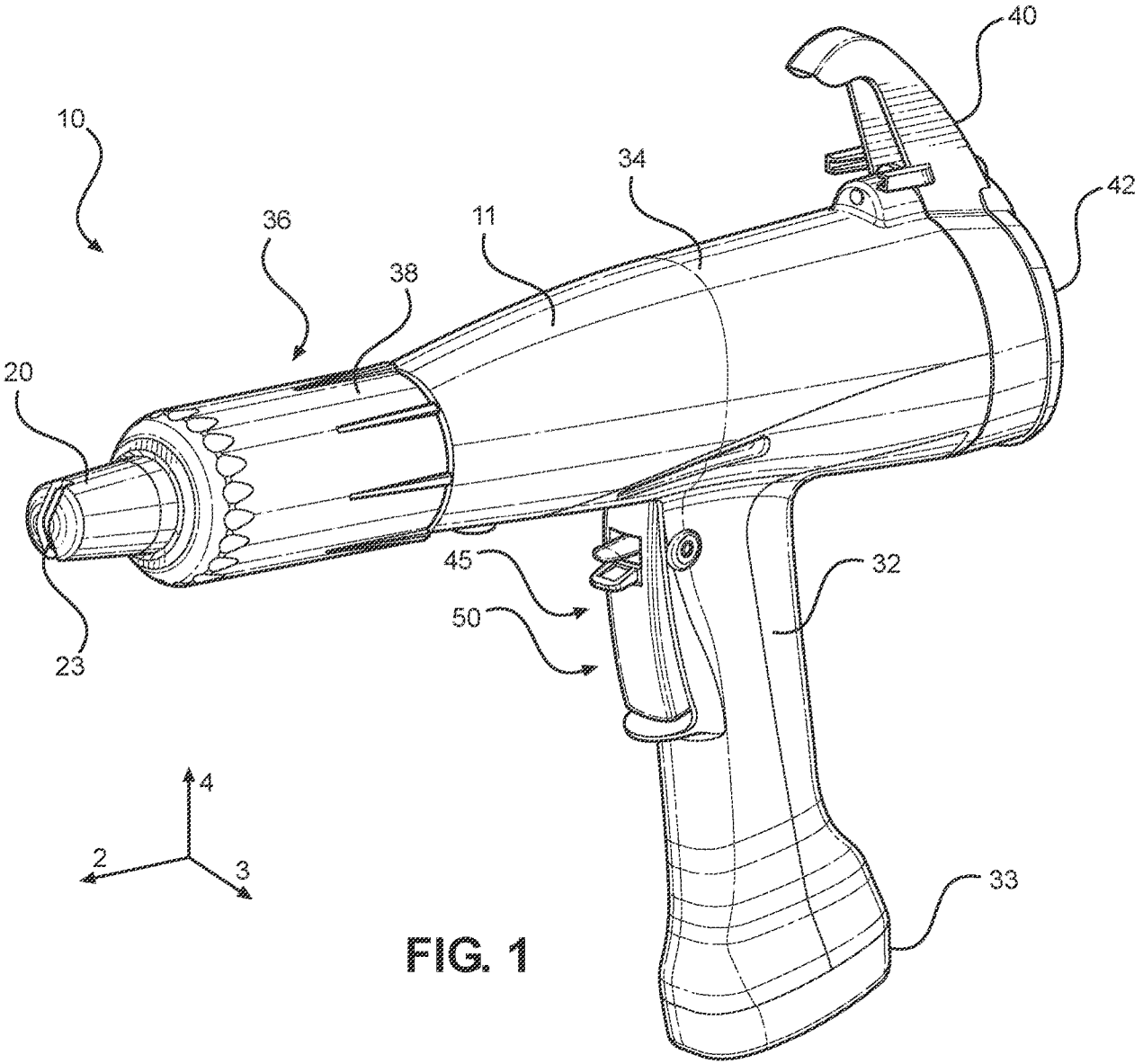
FIG. 1 is a front perspective view of a spray gun according to an embodiment of the present disclosure without a light assembly attached.

Described herein is a spray gun 10, 10*a*, 10*b* that includes a voltage multiplier 140, 666 and a transformer 160, 668 that produces a magnetic field H. The spray gun 10 further includes a light assembly 15, 15*a*, where the light assembly 15, 15*a* includes an LED 268, 400 configured to be powered by electrical energy inductively obtained from the magnetic field H. Certain terminology is used to describe the spray gun 10, 10*a*, 10*b* in the following description for convenience only and is not limiting. The words "right", "left", "lower," and "upper" designate directions in the drawings to which reference is made. The words "inner" and "outer" refer to directions toward and away from, respectively, the geometric center of the description to describe spray gun 10, 10*a*, 10*b* and related parts thereof. The words "forward" and "rearward" refer to directions in a longitudinal direction 2 and a direction opposite the longitudinal direction 2 along the spray gun 10, 10*a*, 10*b* and related parts thereof. The terminology includes the above-listed words, derivatives thereof and words of similar import.

Unless otherwise specified herein, the terms "longitudinal," "vertical," and "lateral" are used to describe the orthogonal directional components of various components of the spray gun 10, 10*a*, 10*b*, as designated by the longitudinal direction 2, lateral direction 3, and vertical direction 4. It should be appreciated that while the longitudinal and lateral directions 2, 3 are illustrated as extending along a horizontal plane, and the vertical direction 4 is illustrated as extending along a vertical plane, the planes that encompass the various directions may differ during use.

The Spray Gun

Figure 2:
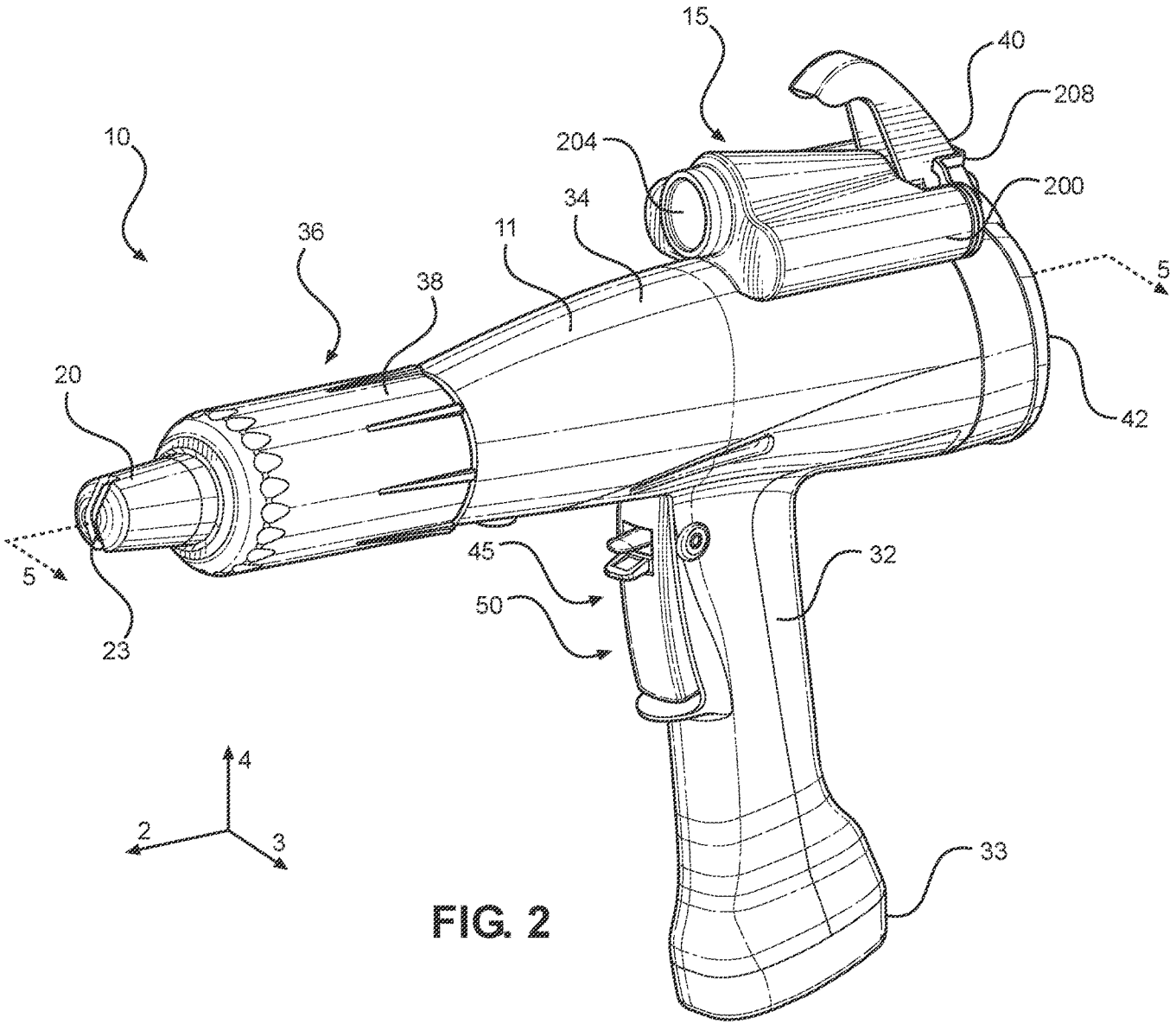
FIG. 2 is a front perspective view of a spray gun according to an embodiment of the present disclosure with a light assembly attached.
Figure 3:
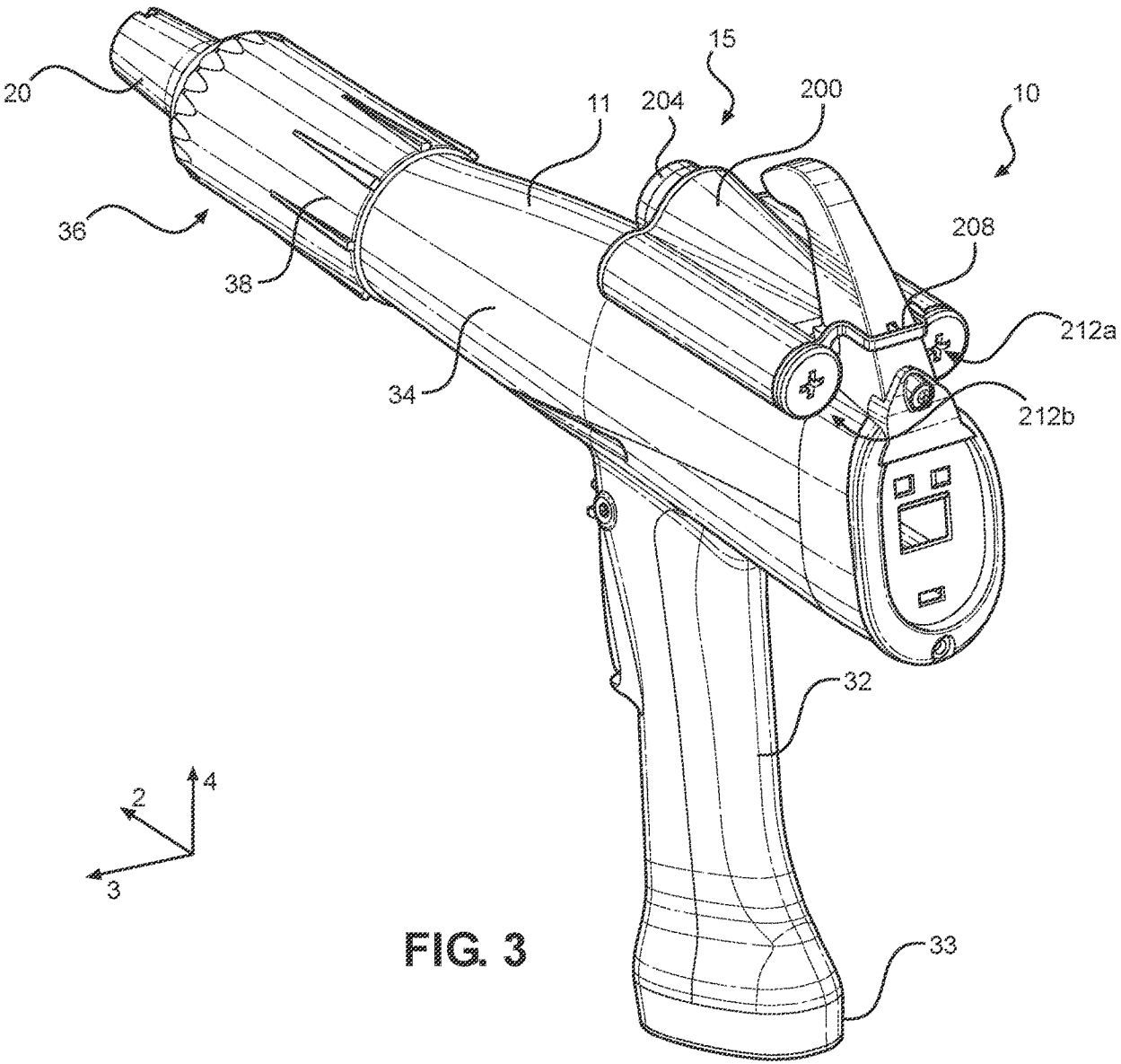
FIG. 3 is a rear perspective view of the spray gun shown in FIG. 2.

With reference to FIGS. 1-3, a spray gun 10 may include a gun body 11, which may define a barrel 34, a nozzle assembly 36 that extends from the barrel 34 along a longitudinal direction 2, and a handle 32. The spray gun 10 may be manually operated. The spray gun 10 may be, for example, an ENCORE® model manual spray gun, which is available commercially from Nordson Corporation, Westlake, Ohio. The ENCORE® model manual spray gun is designed for applying a powder coating material, such as a dilute phase powder from a Venturi pump or a dense phase powder from a high density, low velocity (HDLV) pump, to a work piece. Typically, the nozzle assembly 36, barrel 34, and handle 32 are each a multi-piece assembly, and are also separable from each other. However, the present disclosure is not limited to any particular design, shape, or configuration of the spray gun 10 or its constituent parts. The spray gun 10 may include machined parts, molded parts, combinations thereof, integrated portions, and so on. The barrel 34 of the spray gun 10 can include an applicator hook 40 extending upwardly from the top of the barrel 34. The spray gun 10 can also include a light assembly 15 that may be releasably attached to the barrel 34. FIG. 1 depicts the spray gun 10 without the light assembly 15 attached, while FIGS. 2 and 3 depict the spray gun 10 with the light assembly 15 attached. The light assembly 15 and its means of engaging the spray gun 10 will be discussed further below.

Figure 4:
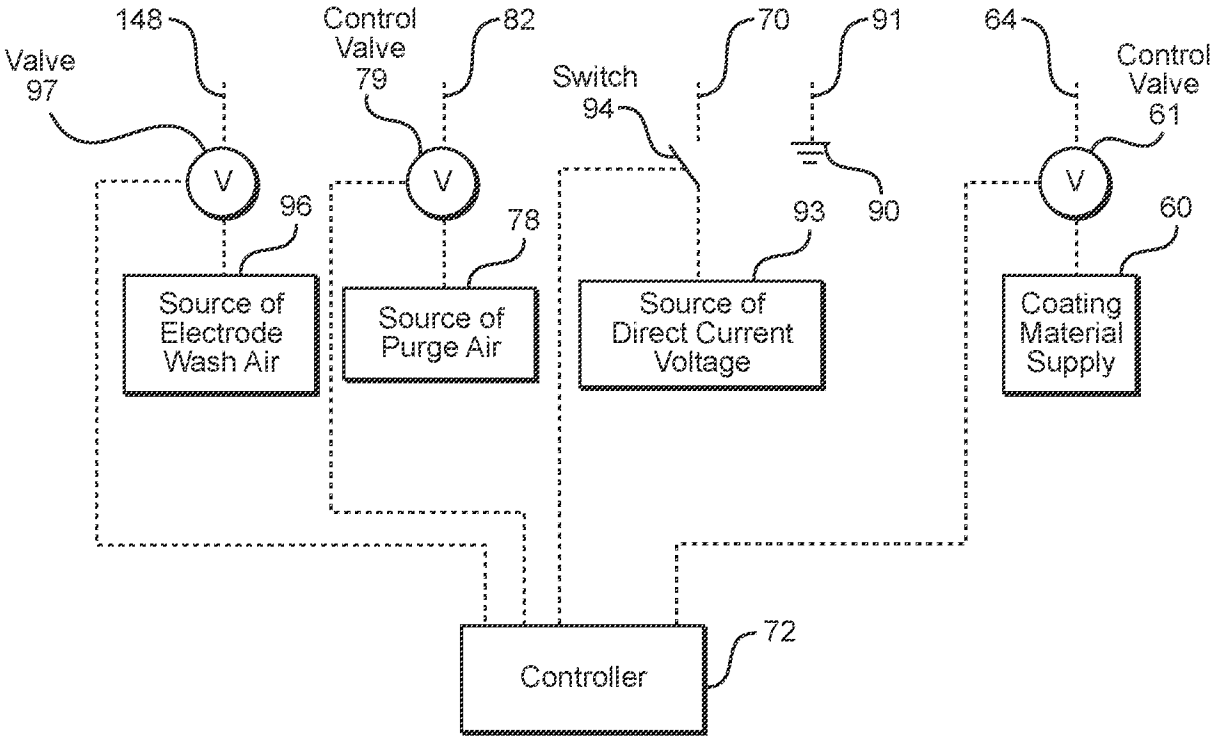
FIG. 4 is a schematic illustration of a spray gun according to an embodiment of the present disclosure.

As shown, the handle 32 is configured to be manually gripped and may include a portion that contacts the user's hand and is grounded. In one embodiment, the handle 32 is connected to an electrical ground 90 through a wire 91 (FIG. 4). The handle 32 defines a base 33, through which inputs and other connections to the spray gun 10 may enter, which will be described further below. The handle 32 may further include an actuator assembly 45, which allows a user to manually initiate and end operation of the spray gun 10. In one embodiment, the actuator assembly 45 may be a trigger assembly 50. However, other embodiments of actuator assembly 45 are contemplated, such as switches, knobs, levers, etc. For purposes of this description, the term "handle" is used to generally refer to any structure, assembly, or member that is manually held or gripped by an operator during operation of the spray gun 10 to support and control the spray gun 10, with a handle, grip, or other structure being embodiments of such a handle 32.

Turning to FIG. 4, as noted above, the handle 32 defines the base 33, through which inputs and other connections to the spray gun 10 may enter. A coating material supply 60 may be used as a source of coating material to the spray gun 10. Coating material may be conducted from the coating material supply 60, through a coating material flow control valve 61, and through a supply hose 64 to the spray gun 10. The supply hose 64 may be connected to an inlet tube 154, which will be discussed below. Although the coating material flow control valve 61 may control flow of coating material to the spray gun 10, in another embodiment of the invention, the coating material flow control valve 61 controls a flow of air to a coating material pump (not shown). When coating material is to be conducted to the spray gun 10, a controller 72 operates the coating material flow control valve 61 to enable coating material to be conducted from the coating material supply 60. The controller 72 may be any suitable arrangement as is known in the art for controlling input power and operation of the spray gun electrical requirements, as well as controlling operation of the coating material supply 60, purge air supply 78 for cleaning a coating material flow path 19 (FIG. 5, to be described), coating material flow control valve 61, and other related features. The coating material supply 60 may have many different constructions, and may contain different types of coating materials, such as powder or liquid coating materials. The flow of coating material from the coating material supply 60 to the nozzle assembly 36 may be controlled by the actuator assembly 45. Upon manual actuation of the actuator assembly 45, the controller 72 actuates the coating material flow control valve 61 from a closed position to an open position, which allows the coating material to flow through the supply hose 64 to the spray gun 10. The coating material supply 60 typically includes a pump (not shown) that is under the control of the controller 72, so that the controller 72 starts the pump in response to the operator actuating the actuator assembly 45. Starting the pump causes coating material to flow through the handle 32, the barrel 34, and out through a spray outlet 104 defined by the nozzle 20 to form a desired spray pattern.

Figure 5:
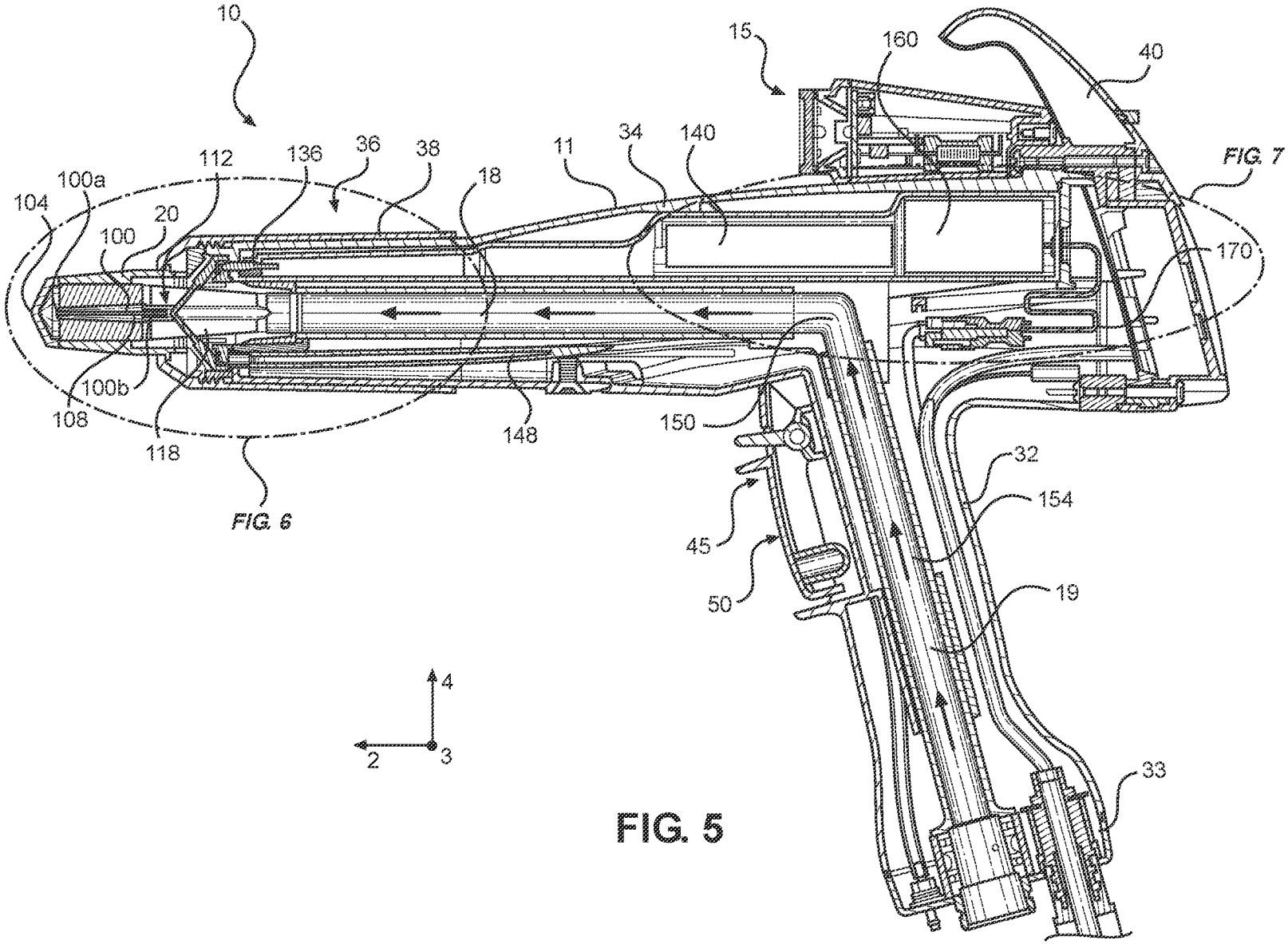
FIG. 5 is a cross-sectional view of the spray gun illustrated in FIG. 2, in longitudinal cross section along line 5-5 shown in FIG. 2.

The spray gun 10 also includes a power source 93 that is configured to power a voltage multiplier 140 (FIG. 5). The power source 93 may be a source of direct current voltage, as indicated in FIG. 4, or may be a source of alternating current voltage. An electrical cable or connection 70 may be provided between the controller 72 and an electrical input 170 of the voltage multiplier 140. To energize the voltage multiplier 140, the controller 72 causes switch 94 to be moved from the illustrated open position to a closed position to connect the power source 93 to the electrical input 170, and thus the voltage multiplier 140.

Simultaneously upon opening the coating material flow control valve 61 and closing the switch 94, the controller 72 may actuate a valve 97 from a closed position to an open position to enable air under pressure from an electrode wash air source 96 to flow through an air passageway 148 (FIG. 5). The air passageway 148 extends through the handle 32 of the spray gun 10, through the barrel 34, and to the nozzle assembly 36. The function of the pressurized air from electrode wash air source 96 will be discussed further below.

The spray gun 10 may also include a purge air supply 78 controlled by the controller 72. The purge air supply 78 may be used to provide pressurized purge air or other gas through a control valve 79 and a purge hose 82, which connects the purge air supply 78 to the spray gun 10. The purge hose 82 may be connectable to a suitable connector (not shown) on the handle 32. When the purge air supply 78 is to be accessed, a signal is sent to the controller 72 to initiate the flow of purge air through the control valve 79, thus opening the control valve 79 from a closed position to an open position. At this time, coating material flow control valve 61 is closed to interrupt the flow of coating material through the supply hose 64. In particular, purge air may be introduced into the spray gun 10 through an inlet (not shown) disposed through the base 33 of the handle 32. The purge air supply 78 and related elements may be configured to purge a coating material flow path 19 (described further below) whenever a new coating material is to be introduced that has different features, such as a different color, than the previous coating material. This can prevent unwanted contamination of the new coating material.

Figure 6:
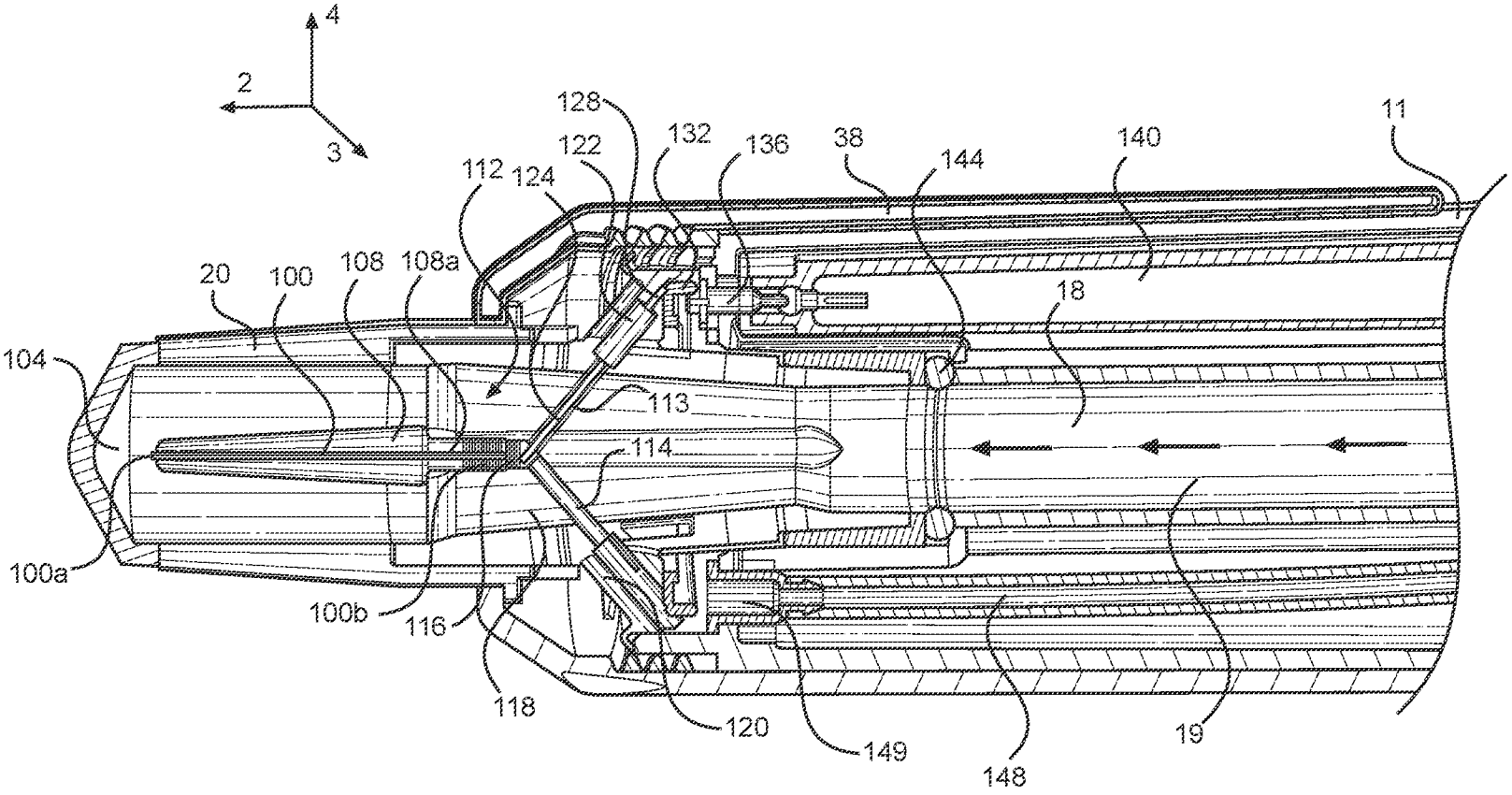
FIG. 6 is a cross-sectional view of a forward section of the spray gun of FIG. 2, noted by the forward encircled region in FIG. 5.

Referring to FIGS. 5 and 6, the nozzle assembly 36 is attached to a forward end of the barrel 34 along the longitudinal direction 2. The nozzle assembly 36 may include a nozzle 20, as well as a nozzle nut 38 configured to attach the nozzle 20 to the barrel 34. The nozzle nut 38 may be releasably attached to the barrel 34 by a variety of means. In one embodiment, the nozzle nut 38 is threaded. The nozzle 20 can be configured to accommodate a variety of desired spray patterns. For example, the nozzle 20 may be a slot type nozzle 23. However, other nozzle configurations are contemplated.

With reference to FIGS. 4 and 5, the supply hose 64 may connect to an inlet tube 154, which may extend up through the handle 32 and mate, with a telescopic connection for example, with one end of an elbow adapter 150. The elbow adapter 150 has another end that may mate, through a telescopic connection for example, with a first end of an outlet tube 18. The outlet tube 18 may extend along the barrel 34 to the nozzle assembly 36, such that coating material exits through the forward end of the outlet tube 18, and into and through the nozzle 20. In alternative embodiments, for example, the outlet tube 18 may itself form or provide an outlet orifice through which coating material exits the nozzle 20. The inlet tube 154, the elbow adapter 150, and the outlet tube 18 may combine to form a coating material flow path 19 (as represented by the arrows associated with the numeral 19), which extends from the handle 32, along the barrel 34, and to the nozzle assembly 36. In FIG. 5, a portion of the coating material flow path 19 is disposed within the interior volume of the handle 32. However, the coating material flow path 19 may include portions that are part of an exterior wall of the handle 32. Additionally, the coating material flow path 19 may be defined by passageways that are integrally formed in the gun body 11 of the spray gun 10.

With continued reference to FIGS. 4-6, the air passageway 148, which connects to the electrode wash air source 96, may extend up through the handle 32, along the barrel 34, and into the electrode support assembly 112, through angled duct 114, and through electrode passage **108*a* to help prevent accumulation of coating material on the electrode tip 100*a*. A filter 149 can be connected to the air passageway 148 to prevent coating material from migrating back into the air passageway 148. Further, an electrode support assembly 112 can be contained within the nozzle assembly 36. The electrode support assembly 112 may include an electrode holder 108 that has a first end that is received in a spider 118, which is connected to the outlet tube 18. The electrode support assembly 112 may be connected to the outlet tube 18 by an interference fit, in which a rearward end of the electrode support assembly 112 forms an interference fit with a forward end of the outlet tube 18. A seal 144 may be disposed around the forward end of the outlet tube 18 to prevent coating material from leaking into the rearward section of the gun body 11. Alternatively, the outlet tube 18 may be positioned and held adjacent to the spider 118 by a retaining seal member (not shown). The spider 118 may be captured between the spray nozzle 20 and a forward end of the barrel 34 when the nozzle nut 38 is tightened onto the front end of the barrel 34. The electrode holder 108 may define an electrode passage 108***a* that extends through the electrode holder 108 in the longitudinal direction 2. The electrode passage 108*a* may be configured to receive an electrode 100. The electrode 100 may define an electrode tip 100*a* that extends outside the electrode holder 108 in the longitudinal direction 2. However, the electrode tip 100*a* may extend from the electrode holder 108 in any combination of the longitudinal direction 2, lateral direction 3, and vertical direction 4. The electrode 100 may include a coiled end 100*b* disposed opposite the electrode tip 100*a* along the longitudinal direction 2. The coiled end 100*b* may extend into a blind bore 116 defined by the spider 118. The spider 118 may define two angled ducts 113 and 114 that extend outward through a flange 120. In one of the angled ducts 113, a current limiting resistor 122 may be disposed, which may have a first lead 124 that contacts the coiled end 100*b* of the electrode 100 and a second lead 128 that contacts a conductive ring 132. The conductive ring 132 may be supported on a back side of the flange 120. The conductive ring 132 may also be connected to an output contact pin 136, which may also be connected to a voltage multiplier 140 that is disposed within the gun body 11. As such, the voltage multiplier 140 is electrically connected to the electrode 100, such that the electrode 100 may receive high voltage electrical energy from the voltage multiplier 140. The electrode 100 then establishes an electrical field, which charges the coating material as it exits the nozzle assembly 36. The voltage multiplier 140 will be discussed further below.

Many different types of electrodes may be used, such as electrode tips that are positioned outside the nozzle assembly 36. Additionally, many different types of power supply designs, configurations, and locations may be used other than the voltage multiplier 140 disposed within the spray gun 10. For example, the spray gun 10 may include a power supply that is completely external to the spray gun 10. The electrode support assembly 112 also includes flow passages (not shown) that allow coating material to flow past the spider 118 and into the spray nozzle 20. An air passageway 148, which receives pressurized air from an electrode wash air source 96, may extend up through the handle 32, through the barrel 34, and into the electrode support assembly 112 and into the nozzle 20 to provide electrode wash air to the nozzle assembly 36. In particular, the pressurized air may flow through the air passageway 148, through an air fitting (not shown), and into the ducts 113 and 114 of the spider 118.

Figure 7:
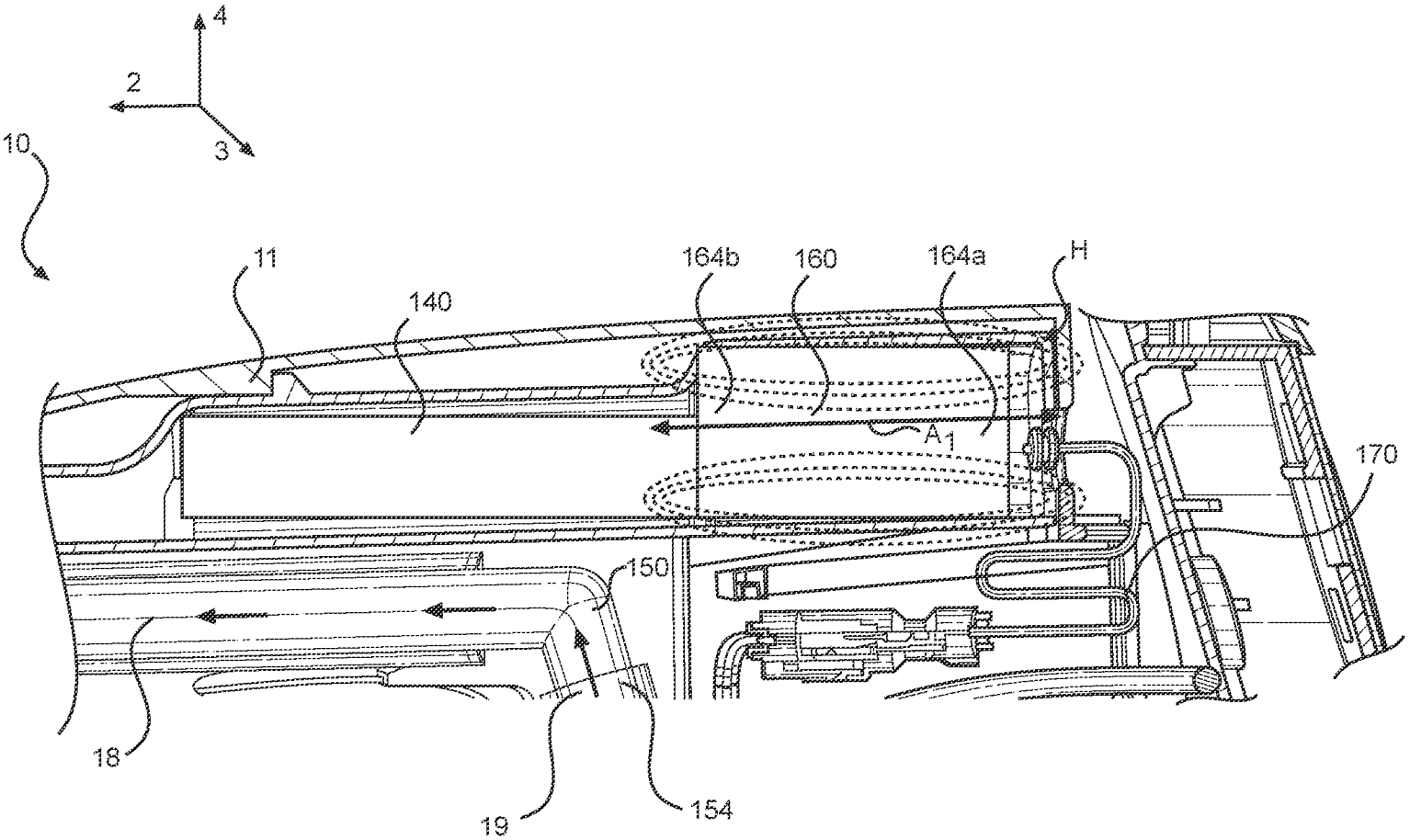
FIG. 7 is a cross-sectional view of a rearward section of the spray gun of FIG. 2, noted by the rearward encircled region in FIG. 5
Figure 8:
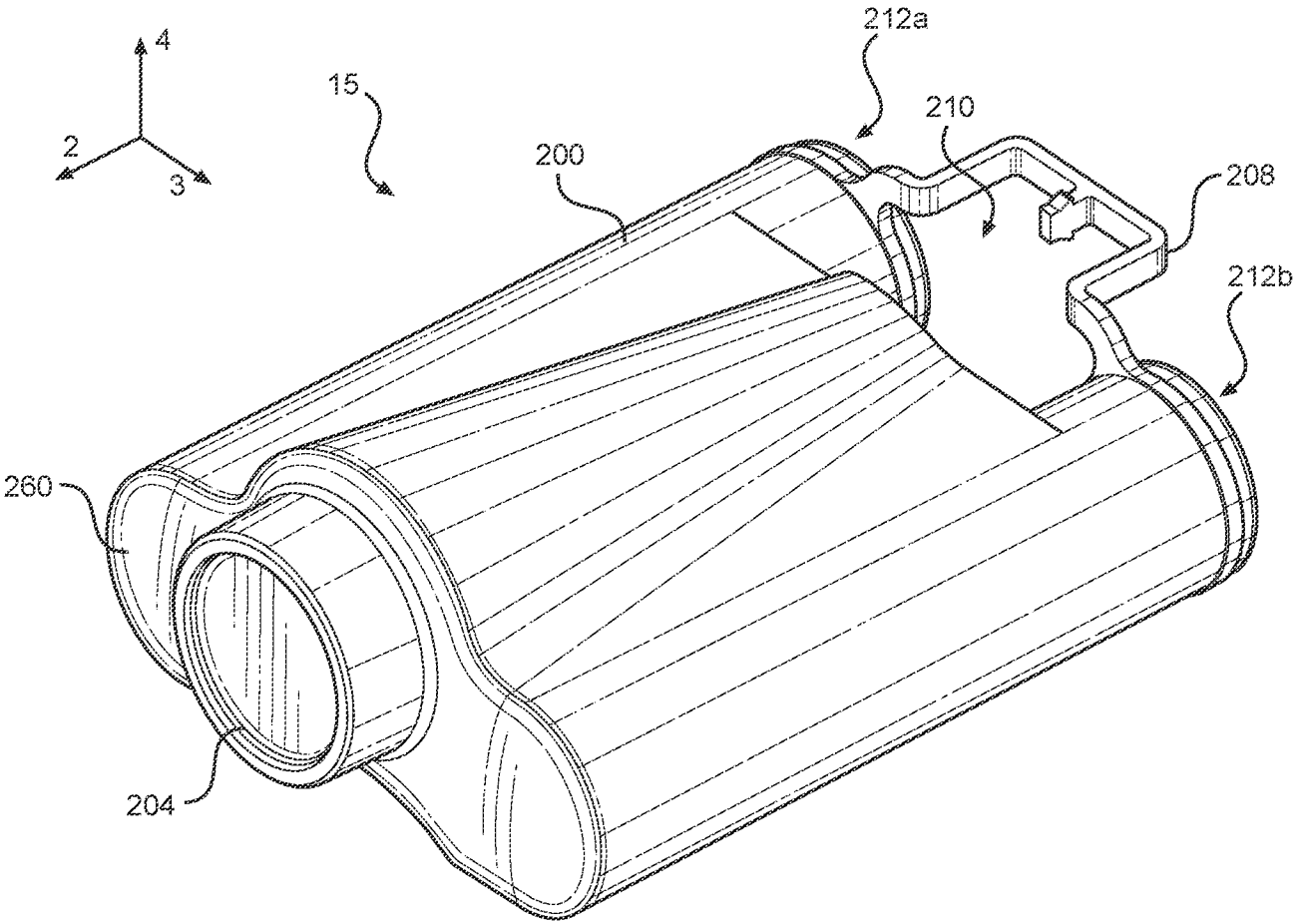
FIG. 8 is a front perspective view of the light assembly of the spray gun shown in FIG. 2.
Figure 9:
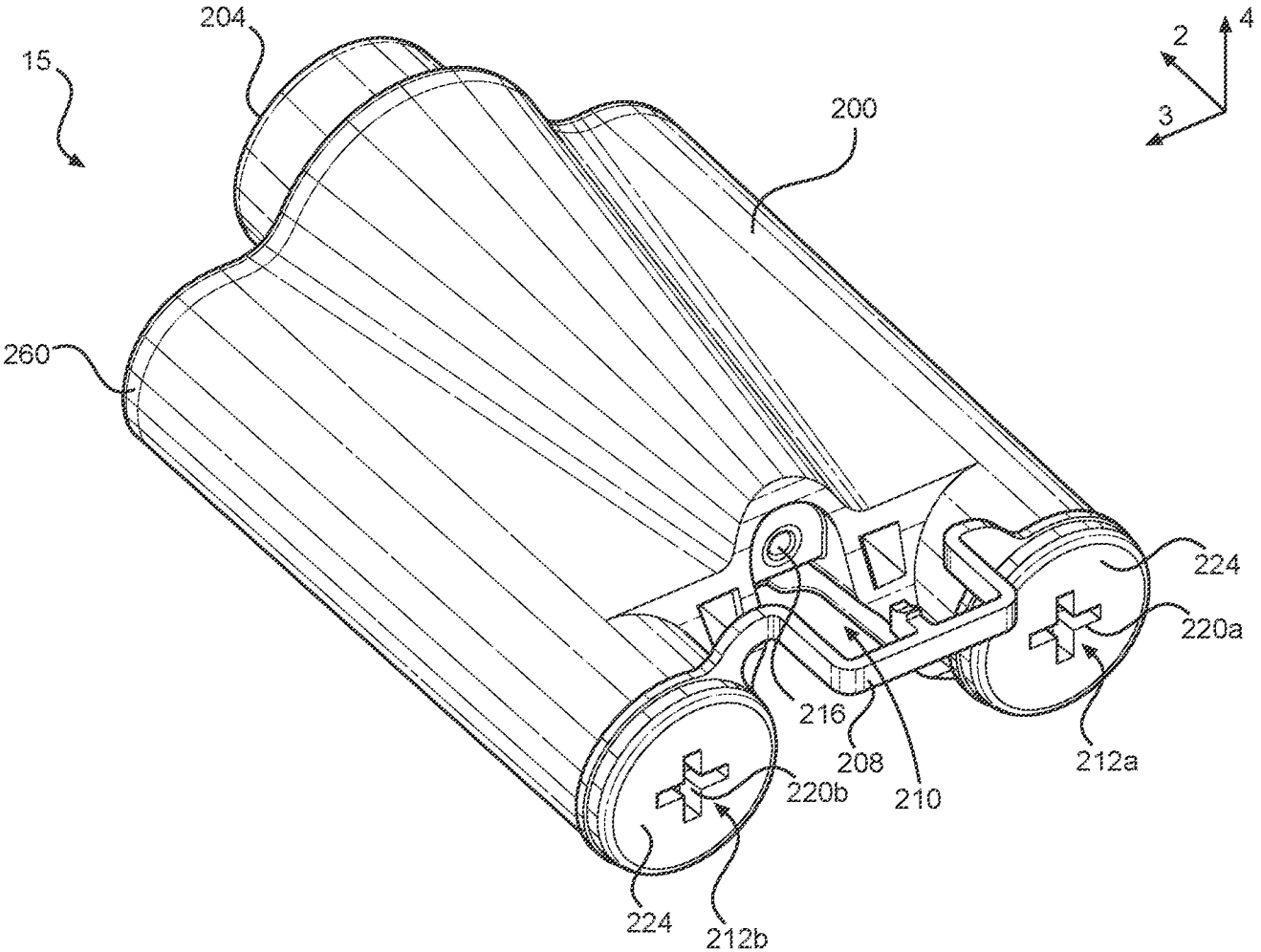
FIG. 9 is a rear perspective view of the light assembly shown in FIG. 8.

Turning to FIGS. 5 and 7, the voltage multiplier 140 and related components of the spray gun 10 will be described. Because the coating material is not initially charged when it enters the spray gun, the voltage multiplier 140, through the electrode 100, serves to charge the coating material as it passes through the spray gun 10. Upon actuation of the actuator assembly 45 by a user of the spray gun 10, the voltage multiplier 140 is simultaneously energized. As a result, the voltage multiplier 140 enables the electrode 100 to establish an electrical field within the nozzle assembly 36.

The voltage multiplier 140 is electrically connected to the electrical input 170, which connects the voltage multiplier 140 to the electrical cable 70 of the spray gun 10, and likewise to the power source 93. When the controller 72 actuates the switch 94 from an open position to a closed position, the voltage multiplier 140 is activated, such that the voltage multiplier 140 is electrically connected to the power source 93. Likewise, when the controller 72 actuates the switch 94 from the closed position to the open position, the voltage multiplier 140 is deactivated, such that the voltage multiplier 140 is electrically disconnected from the power source 93. As a result, the voltage multiplier 140 is configured to alternate between an activated state and a deactivated state. In one embodiment, the actuator assembly 45 directs the controller 72 to actuate the switch 94. As such, in this embodiment, the actuator assembly 45 switches the voltage multiplier 140 between the activated state and the deactivated state.

The power source 93 may be configured to provide low voltage direct current to the voltage multiplier 140. The voltage multiplier 140 may include an oscillator that converts the low voltage direct current from the power source 93 to an alternating current. The voltage multiplier 140 may further include a transformer 160 that increases the voltage from the oscillator. The voltage multiplier 140 may increase the voltage to a very high voltage, such as to 80,000 to 100,000 volts, for example. The transformer 160 may include a first end 164*a* and a second end 164*b* opposite the first end 164*a* along a first central axis $A_1$. In one embodiment, the first central axis $A_1$ may be parallel to the longitudinal direction 2. However, the first central axis $A_1$ may extend along any of the longitudinal direction 2, lateral direction 3, vertical direction 4, or any combination thereof. When the voltage multiplier 140 is activated and a voltage is applied to the voltage multiplier 140, the transformer 160 produces a magnetic field H.

Releasably Attached Light Assembly

With reference to FIGS. 8-13, the light assembly 15 will be discussed in greater detail. The light assembly 15 includes a battery housing 200 that is generally hollow for housing various components of the light assembly 15, such as the batteries 248. The battery housing 200 can comprise a polycarbonate plastic, though other materials are contemplated. The battery housing 200 can also include a thread insert 216, which can comprise a metal or another material having a greater hardness than that of the battery housing 200. The thread insert 216 can be configured to receive a screw 232*b*, as will be described further below. Though the light assembly 15 is shown as including two batteries 248, the light assembly 15 may include one battery, or more than two batteries as desired. Each of the batteries 248 can define a first end 248*a* and a second end 248*b*, where each of the first and second ends 248*a*, 248*b* defines a different polarity. The battery housing 200 can define a plurality of battery chambers, where each is sized to receive a corresponding one of the batteries 248. For example, as shown in the depicted embodiments, the battery housing 200 can define a first battery chamber 200*a* and a second battery chamber 200*b* spaced from the first battery chamber 200*a* along the lateral direction 3. Though two battery chambers are shown, the battery housing 200 can define more battery chambers as desired. The first and second battery chambers 200*a*, 200*b* can be separated by a central chamber 202 that is configured to receive an inductor printed circuit board assembly (PCA) 258, which will be described further below. Each of the batteries 248 disposed within the first and second battery chambers 202*a* and 202*b* can be a non-rechargeable battery, such as a conventional triple A or double A Alkaline battery. However, the batteries 248 can comprise other types of non-rechargeable or rechargeable batteries as desired. The batteries 248 can be connected in parallel or series and function as one power supply for the light assembly 15, such that the light assembly 15 can operate independently without any external power input.

To secure the batteries 248 within the battery housing 200, the light assembly 15 can include a first battery cap assembly 212*a* and a second battery cap assembly 212*b*. Though two battery cap assemblies are shown, the number of battery cap assemblies can vary, but will generally correspond to the number of batteries 248 contained within the battery housing 200. Each of the first and second battery cap assemblies 212*a*, 212*b* can include a battery cap 224 and a battery contact 228. The battery contact 228 can comprise a conductive material, such as nickel plated steel. However, it is contemplated that any variety of conductive materials can comprise the battery contacts 228. When the light assembly 15 is fully assembled, each battery contact 228 can be disposed between the respective battery cap 224 and the first end 248*a* of the respective battery 248, such that the battery contact 228 is in direct contact with the first end 248*a* of the battery 248. As a result, the battery contact 228 functions as a conductive medium between the first end 248*a* of the battery 248 and the LED PCA 256. Each battery cap 224 can secure the corresponding battery contact 228 and battery 248 within the battery housing 200, as well as the battery contact 228 in direct contact with the battery 248, through direct engagement with the battery housing 200. In the depicted embodiment, each battery cap 224 defines an external threading that is configured to engage an internal threading defined on the inner surface of the battery housing 200 to releasably lock the battery cap 224 to the battery housing 200. Though a threaded engagement is shown for securing the battery caps 224 to the battery housing 200, other methods of engagement are contemplated, such as a press-fit or snap engagement.

Each of the battery caps 224 can define a respective key 220*a*, 220*b* in a side of the battery cap 224 that faces outward when the first and second battery cap assemblies 212*a*, 212*b* are attached to the battery housing 200. The keys 220*a*, 220*b* have multiple functions—their shape can indicate to an operator of the spray gun 10 the polarity of the batteries 248 disposed within the battery housing 200, as well as be shaped to allow the operator to engage the battery caps 224 with a particular tool for unthreading the first and second battery cap assemblies 212*a*, 212*b* from the battery housing 200. For example, the keys 220*a*, 220*b* can be shaped as plus signs. This indicates to the operator that the first end 248*a* of the batteries 248 have a positive polarity, and allows the operator to disengage the first and second battery cap assemblies 212*a*, 212*b* from the battery housing 200 using either a standard or Phillips screwdriver. Though the keys 220*a*, 220*b* are shown shaped as plus signs, other shapes and configurations are contemplated.

The light assembly 15 can also include a lanyard 208 for receiving first and second battery cap assemblies 212*a*, 212*b*. The lanyard 208 can be substantially flexible, and can be comprised of plastic or a similarly bendable material. The lanyard 208 defines an elastomer that defines a first opening 209*a* on one lateral side and a second opening 209*b* on the other lateral side. Though two openings are depicted, the lanyard 208 can define more openings as desired, though the number of openings will generally correspond to the number of battery cap assemblies. The first opening 209*a* is sized to receive the battery cap 224 of the first battery cap assembly 212*a*, while the second opening 209*b* is sized to receive the battery cap 224 of the second battery cap assembly 212*b*. When the first and second battery cap assemblies 212*a*, 212*b* are disposed through the first and second openings 209*a*, 209*b* and are attached to the battery housing 200, each of the battery caps 224 presses against the lanyard 208 such that the lanyard 208 is firmly secured between the battery caps 224 and the battery housing 200. The first and second openings 209*a*, 209*b* of the lanyard 208 aid in preventing the first and second battery cap assemblies 212*a*, 212*b* from becoming misplaced when the first and second battery cap assemblies 212*a*, 212*b* are detached from the battery housing 200, as the first and second battery cap assemblies 212*a*, 212*b* can remain disposed through the first and second openings 209*a*, 209*b*. As a result, the lanyard 208 and the first and second battery cap assemblies 212*a*, 212*b* can be moved as a unit when detached from the battery housing 200. When the first and second battery cap assemblies 212*a*, 212*b* secure the lanyard 208 to the battery housing 200, a gap 210 is defined between the lanyard 208 and the battery housing 200. The gap 210 can be centrally located between the first battery cap assembly 212*a* and second battery cap assembly 212*b*, and can be configured to receive the applicator hook 40 of the spray gun 10.

Figure 11:
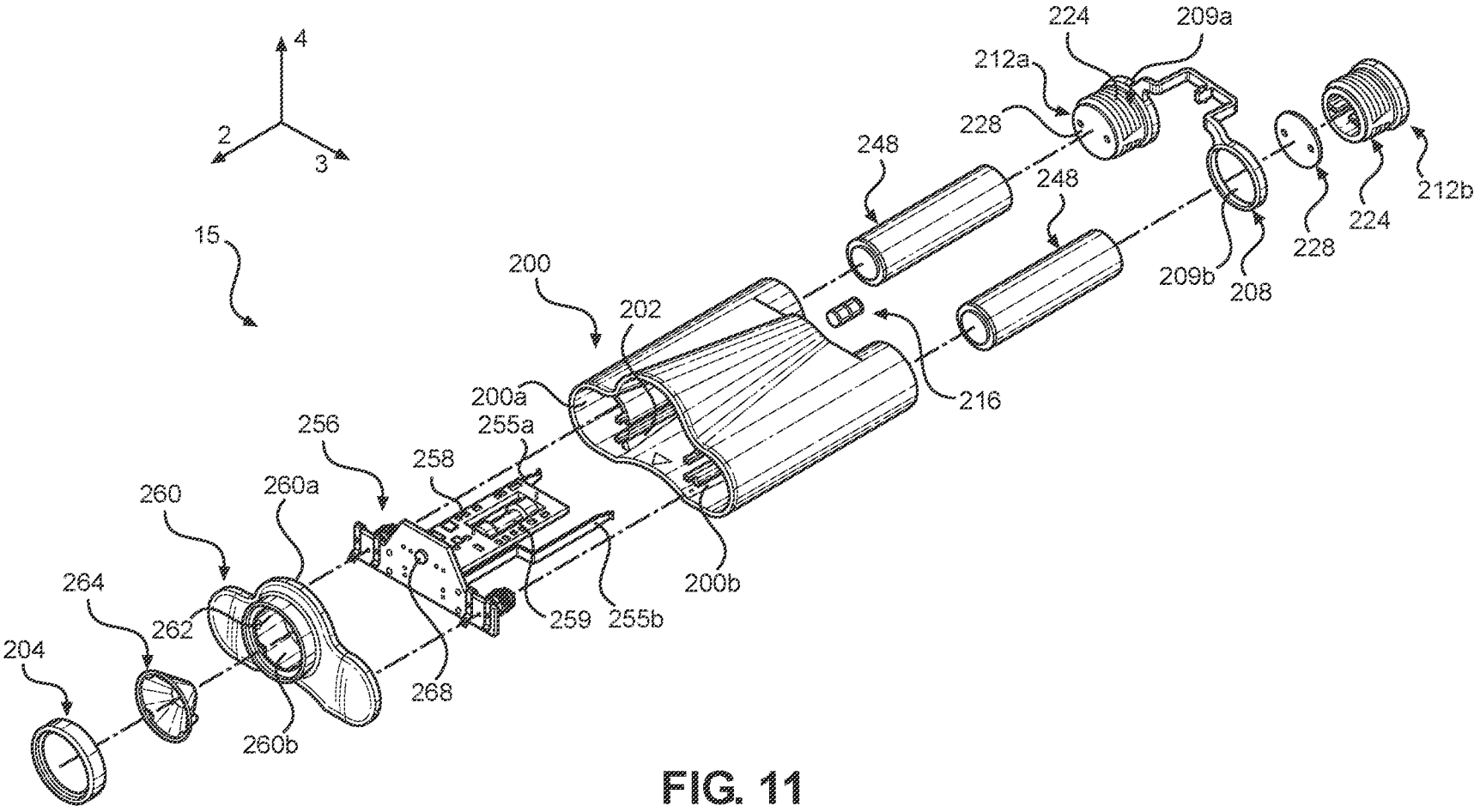
FIG. 11 is an exploded view of the light assembly shown in FIG. 8.
Figure 12:
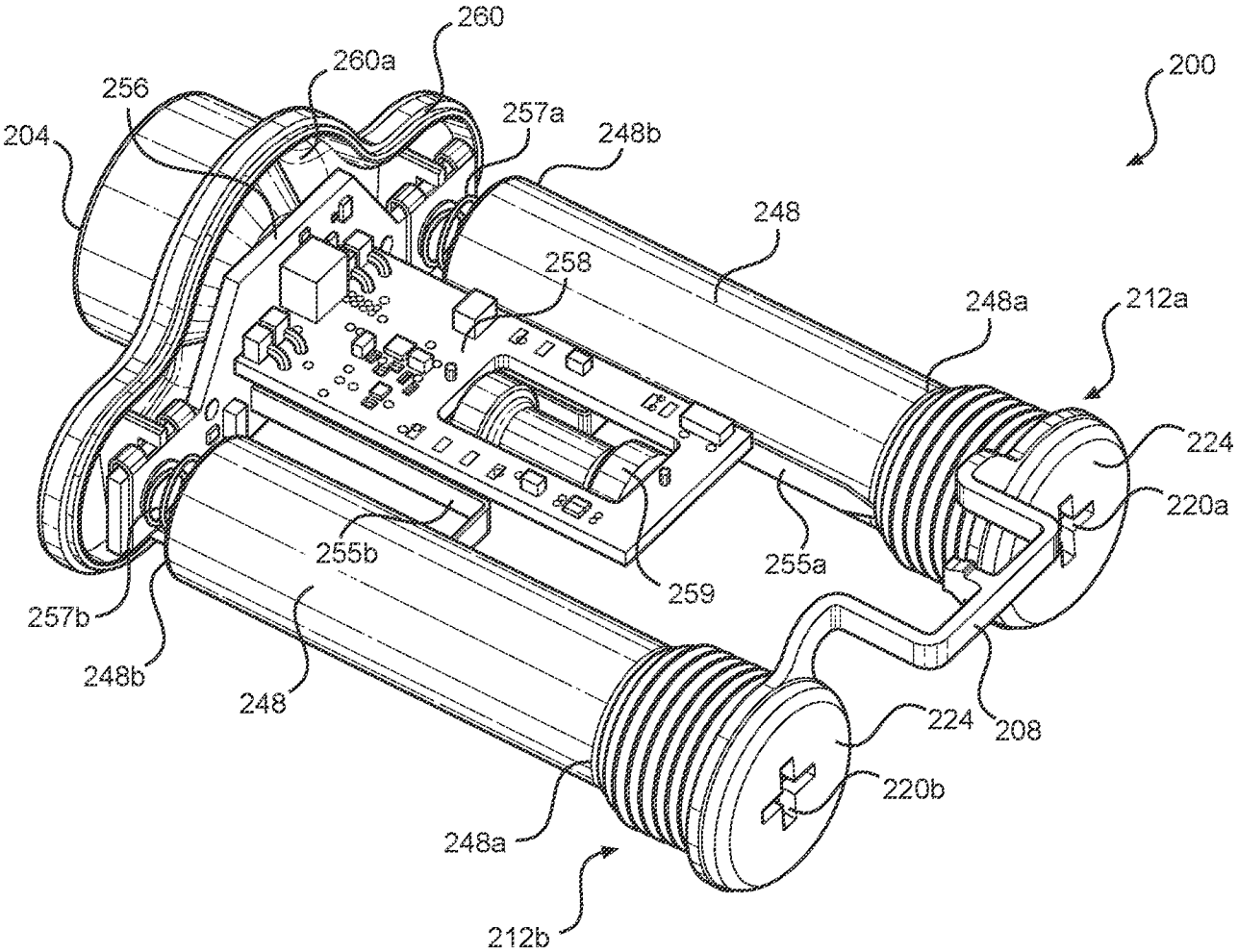
FIG. 12 is a rear perspective view of the light assembly shown in FIG. 8, with the battery housing removed.
Figure 13:
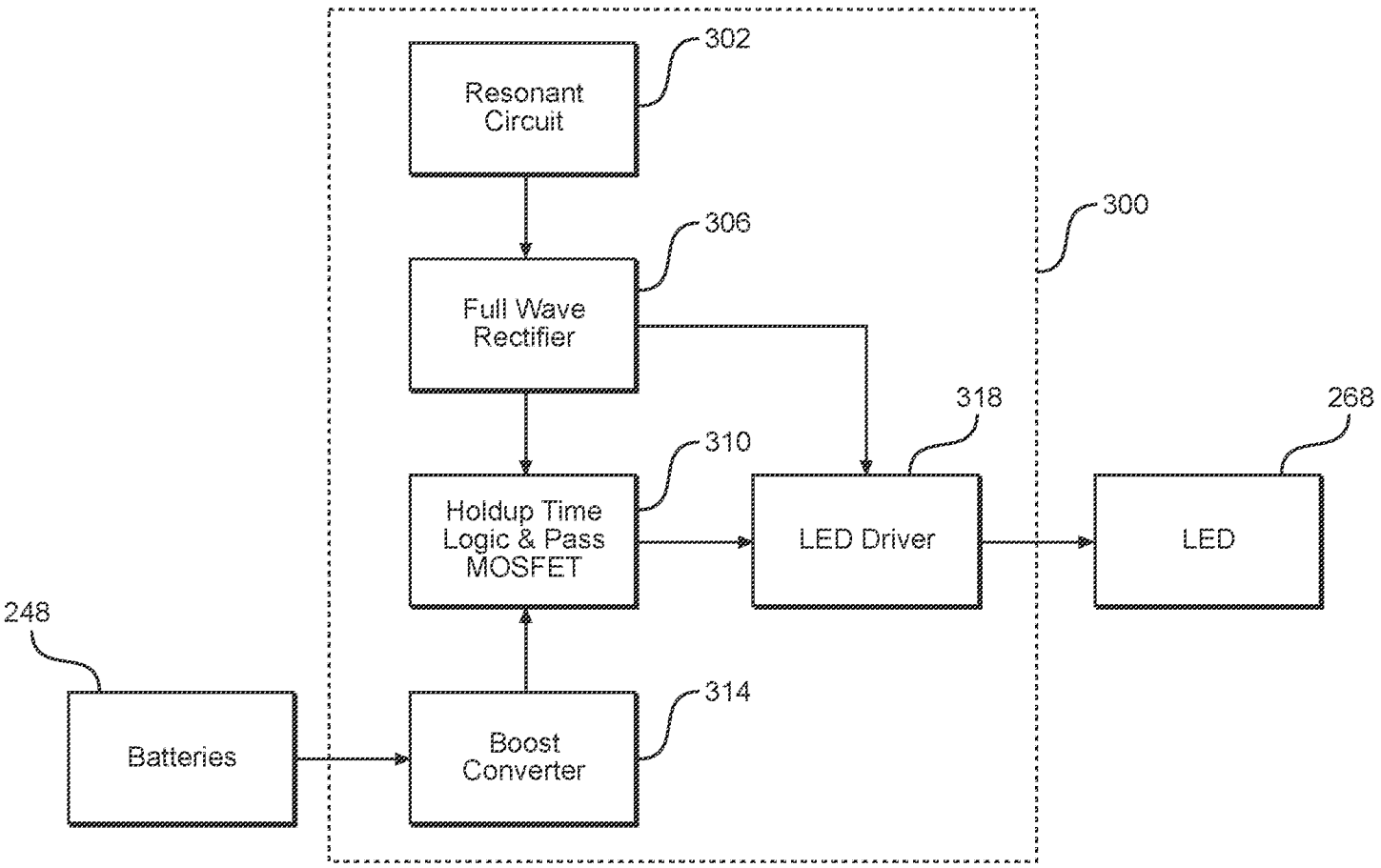
FIG. 13 is a diagram illustrating an embodiment of a circuit of a light assembly according to an embodiment of the present disclosure.

Continuing with FIGS. 11-12, the circuit 300 in FIG. 13 is mounted on an LED PCA 256 and the inductor PCA 258. The inductor PCA 258 can be supported within the central chamber 202 of the battery housing 200 by the LED PCA 256, such that the inductor PCA 258 extends longitudinally from the LED PCA 256 through the central chamber 202. The inductor PCA 258 can also include an inductor 259, in which an electric current can be induced when the inductor 259 is placed in the vicinity of the magnetic field H, as will be discussed below. Opposite the inductor PCA 258, an LED 268 is attached to the LED PCA 256 and is electrically connected to the inductor PCA 258 for illuminating and inspecting a work piece (not shown) to which the coating material from the spray gun 10 is applied. The LED 268 can be a white LED, though other types of LEDs are contemplated. The LED PCA 256 can include a first arm 255*a* and a second arm 255*b* that each extend longitudinally from the LED PCA 256 on opposite sides of the inductor PCA 258. Each of the first and second arms 255*a*, 255*b* can be comprised of an electrically conductive material. When the light assembly 15 is completely assembled, each of the first and second arms 255*a*, 255*b* contacts one of the battery contacts 228. As depicted, the first arm 255*a* contacts the battery contact 228 of the first battery cap assembly 212*a*, and the second arm 255*b* contacts the battery contact 228 of the second battery cap assembly 212*b*. As a result, the first and second arms 255*a*, 255*b* provide the inductor PCA 258 with an electrical connection to the first end 248*a* of the batteries 248 through the battery contacts 228 and the LED PCA 256. The LED PCA 256 can also include a first spring clip 257*a* and a second spring clip 257*b* laterally spaced from the first spring clip 257*a*. Like the first and second arms 255*a*, 255*b*, each of the first and second spring clips 257*a*, 257*b* can be comprised of an electrically conductive material. When the light assembly 15 is completely assembled, each of the first and second spring clips 257*a*, 257*b* contacts the second end 248*b* of a respective one of the batteries 248. As a result, the first and second spring clips 257*a*, 257*b* provide the inductor PCA 258 with an electrical connection to the second end 248*b* of the batteries 248 through the LED PCA 256. The inclusion of the first and second spring clips 257*a*, 257*b* and the first and second arms 255*a*, 255*b* allow the creation of a complete electrical circuit with the batteries 248, LED PCA 256, and inductor PCA 258 within the battery housing 200.

On the end of the battery housing 200 opposite the lanyard 208, the battery housing 200 can be capped with a lens housing 260. Like the battery housing 200, the lens housing 260 may be comprised of a polycarbonate plastic, though other materials are contemplated. The lens housing 260 defines a first side 260*a* that faces the LED PCA 256 and a second side 260*b* opposite the first side 260*a* that faces away from the LED PCA 256. The lens housing 260 may be permanently attached to the battery housing 200 through a weld, which can be an ultrasonic continuous weld. Alternatively, the lens housing 260 can be releasably attached to the battery housing 200, such as through a snap-fit or bayonet type engagement. The lens housing 260 can define a recess 262 that extends from a large opening on the second side 260*b* of the lens housing 260 to a smaller opening on the first side 260*a* of the lens housing 260. When the light assembly 15 is fully assembled, the LED 268 attached to the LED PCA 256 at least partially extends through the smaller opening in the first side 260*a* of the lens housing 260, such that the LED 268 is at least partially disposed in the recess 262. Disposed within the recess 262 is a lens 264 and attached to the lens housing 260 is a lens cover 204, each of which controls the size, shape, and color of the light that is produced by the LED 268 and is emitted from the light assembly 15. For example, the lens cover 204 or lens 264 could be colored to provide the desired color of light. Alternatively, the LED 268 could be replaced to change the desired color of light. The lens cover 204 can be comprised of a substantially transparent material, and functions to protect the lens 264 from environmental contaminants that can damage or obstruct the lens 264. Both the lens 264 and the lens cover 204 can be permanently attached to the lens housing 260, such as through a weld, which can be an ultrasonic continuous weld. Alternatively, both the lens 264 and the lens cover 204 can be releasably attached to the lens housing 260, as will be described further below.

Figure 10:
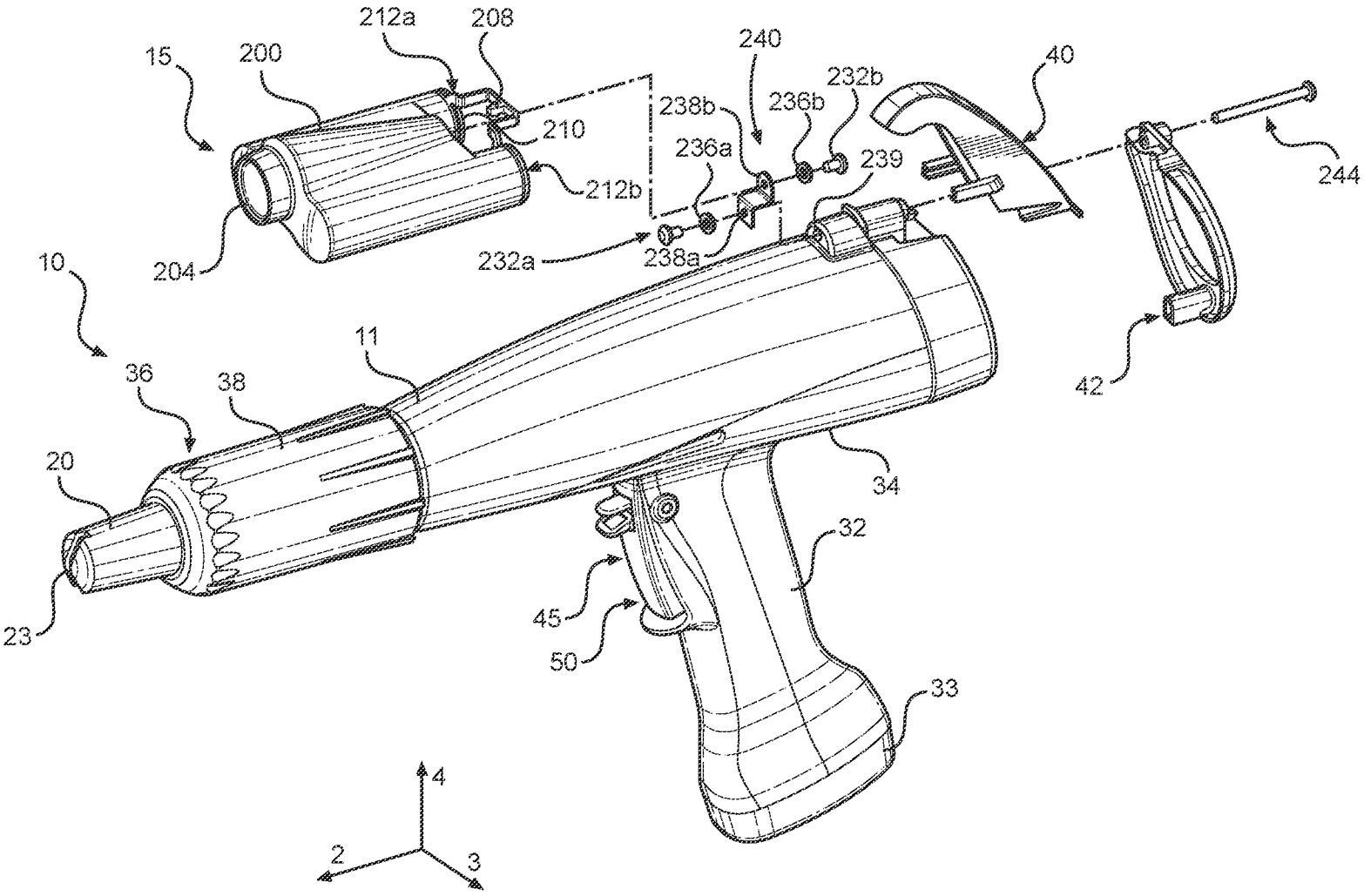
FIG. 10 is an exploded view of the spray gun shown in FIG. 2.

Continuing with FIGS. 8-12, the attachment of the light assembly 15 to the spray gun 10 will be described in greater detail. In particular, the exploded view of FIG. 10 depicts how the parts to be described interrelate. First, a bracket 240 is attached to the barrel 34 of the spray gun 10. The bracket 240 defines a lower hole 238*a* that is configured to receive an assembly, which can be a screw 232*a*. The screw 232*a* can be a conventional threaded screw, or can define any other sort of fastener as desired. The operator of the spray gun 10 can insert the screw 232*a* through the lower hole 238*a* of the bracket 240, such that a washer 236*a* is positioned between the head of the screw 232*a* and the bracket 240, and into a bore 239 defined in the top of the barrel 34. As a result, the bracket 240 is secured to the spray gun 10. Then, the light assembly 15 is placed adjacent the bracket 240, such that the thread insert 216 of the light assembly 15 aligns with an upper hole 238*b* that extends through the bracket 240. The upper hole 238*b* can be positioned on the bracket 240 at a position spaced vertically from the lower hole 238*a*. Once the thread insert 216 and the upper hole 238*a* are aligned, the operator of the spray gun 10 can insert an assembly, which can be a screw 232*b*, through the upper hole 238*a* of the bracket 240, such that a washer 236*b* is positioned between the head of the screw 232*b* and the bracket 240, and into the thread insert 216. As a result, the light assembly 15 is secured to the bracket 240, and likewise the barrel 34 of the spray gun 10.

After the light assembly 15 has been secured to the spray gun 10 with the bracket 240, the applicator hook 40 can be attached to the spray gun 10. The top of the applicator hook 40 is inserted through the gap 210 defined between the lanyard 208 and the battery housing 200 of the light assembly 15, such that the lanyard 208 contacts the rearward side of the applicator hook 40 and a bore (not shown) that extends through the applicator hook 40 aligns with a bore (not shown) that extends into the spray gun 10 from the rear side of the barrel 34. Once the applicator hook 40 is in place, the operator of the spray gun 10 inserts a screw 244 through the bores of the applicator hook 40 and the barrel 34 of the spray gun 10 to secure the applicator hook 40 to the spray gun 10, which likewise further secures the light assembly 15 to the spray gun 10. Optionally, before the screw 244 is inserted, a bezel 42 can be aligned with the applicator hook 40, and the screw 244 can be inserted through the bezel 42, the applicator hook 40, and into the barrel 34 of the spray gun 10. Though one method of attaching the light assembly 15 to the spray gun 10 is described, other methods of attaching the light assembly 15 are also contemplated.

Light Assembly Electrical Components

In operation, the light assembly 15 obtains power either through the batteries 248 or by harvesting energy from the magnetic field H produced by the transformer 160 of the voltage multiplier 140. Continuing with FIG. 13, the electrical components of the light assembly 15 that control how the light assembly 15 is powered will be discussed in greater detail. The electrical components include the batteries 248, the LED 268, and the components of the circuit 300. The circuit 300 controls the supply of power to the LED 268 either from the batteries 248 or the power harvested from the magnetic field H. The batteries 248, as described above, can be connected to and configured to provide power to a DC to DC converter such as a boost converter 314 of the circuit 300. For example, the batteries 248 can provide a 1.5 V direct current to the boost converter 314. However, this direct current voltage can vary, especially due to the continuous discharge of the batteries 248. The boost converter 314 can encompass input and output storage capacitors, and is used to convert the direct current output from the batteries 248 into a constant direct current of increased voltage. For example, the boost converter 314 can convert a 1.5 V direct current from the batteries 248 into a constant 3.3 V direct current. The circuit 300 can also include a bypass capacitor and a zener clamp (not shown) to alleviate the effects of incorrect battery types inserted into the light assembly 15, as well as reverse voltage protection.

The boost converter 314 can supply power to the holdup time logic and switch element such as a pass MOSFET 310. This portion of the circuit 300 is used to determine whether an LED driver 318 is being powered from the resonant circuit 302 or the batteries 248, which will be described further below. When the LED driver 318 is powered from the batteries 248, the holdup time logic and pass MOSFET 310 provides the LED driver 318 with power from the boost converter 314 for a predetermined or adjustable period of time. For example, the period of time can be 15 seconds. The period of time can be a manufacturer setting of the light assembly 15, or can be manipulated by the operator of the spray gun 10 as desired. This limitation of power to the LED driver 318 from the boost converter 314 for a finite period of time helps increase the operating lifetime of the batteries 248 and prevents the LED driver 318 from continuously drawing power from the batteries 248 during periods of inactivity of the spray gun 10.

In addition to the batteries 248, the LED 268 can also be powered by a resonant circuit 302. The resonant circuit 302 comprises an inductor 259 and at least one capacitor. For example, in one embodiment the resonant circuit 302 includes three capacitors. In operation, as the light assembly 15 (and likewise the inductor PCA 258) is mounted to the top of the spray gun 10 at the rear of the barrel 34, the circuit 300, and particularly the inductor 259, is within the magnetic field H produced by the transformer 160 of the voltage multiplier 140. The magnetic field H induces a current in the inductor 259 of the resonant circuit 302, and the resulting energy is stored in the capacitors. The output of the resonant circuit 302 is an alternating current voltage, which is rectified into a DC voltage. For example, the full wave rectifier 306 is used to convert the alternating current voltage from the resonant circuit 302 into a direct current voltage, which can be stored in a plurality of capacitors (not shown). Due to the minimal bulk storage in the capacitors, upon the removal of the magnetic field H, the voltage from the resonant circuit 302 collapses quickly.

In one embodiment, the resonant frequency of the resonant circuit 302 can be tuned to be the same as the drive frequency of the voltage multiplier 140 according to the below equation:

$$F=1/[2*\pi*\sqrt{(L*C)}] \quad \text{Equation 1}$$

where:

F=Resonant Frequency (Hertz)

L=Inductance (Henrys)

C=Capacitance (Farads)

To adjust the resonant frequency of the resonant circuit 302, the inductor 259 can be replaced with an inductor having a different inductance and/or the at least one capacitor can be replaced with a capacitor having a different capacitance such that Equation 1 satisfies the resonant frequency F of the particular voltage multiplier 140 of the spray gun 10 with which the light assembly 15 is being used.

Figure 14A:
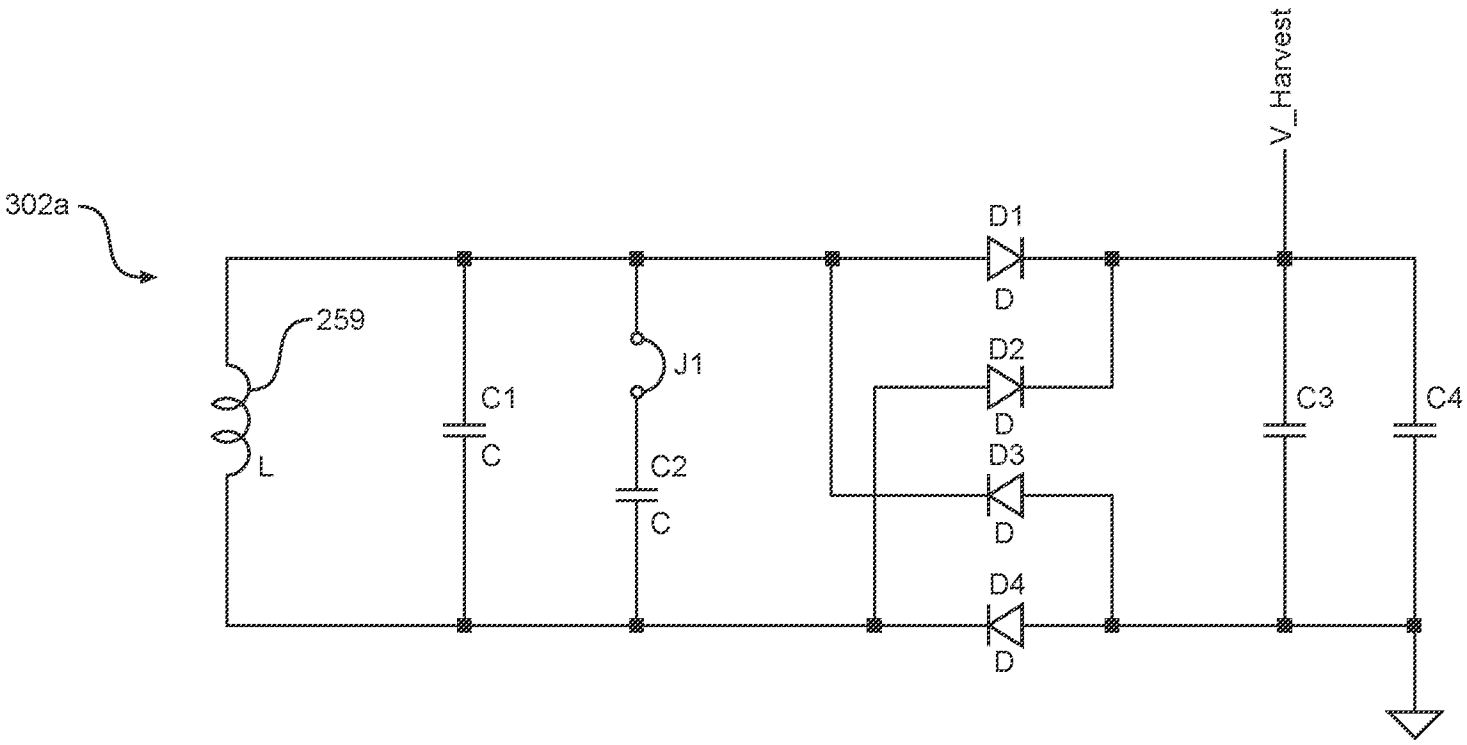
FIG. 14A is a diagram illustrating an embodiment of a resonant circuit of a light assembly according to an embodiment of the present disclosure.

Referring to FIG. 14A, in another embodiment the light assembly 15 can include a resonant circuit 302*a*. The resonant circuit 302*a* includes an inductor 259, capacitors C1-C4, jumper J1, and diodes D1-D4. The inductor 259 and the capacitor C1 are arranged in parallel to form an LC circuit. The LC circuit is configured to store electrical energy when oscillating at its resonant frequency $f_1$. The diodes D1-D4 are arranged to form a full-wave rectifier. The full-wave rectifier may convert the input waveform received from the LC circuit to one of constant polarity that can be used to power an LED 268, as described herein. In the example of FIG. 14A, the resonant frequency of the circuit 302*a* can be adjusted from an initial frequency $f_0$ to a first frequency $f_1$ by inserting or removing the jumper wire J1. When the jumper wire J1 is removed from the circuit 302*a*, the capacitor C2 will be disconnected and the resonant frequency generated by L and C1 will be maintained. When the jumper wire is inserted into the circuit 302*a*, the capacitor C2 may alter the resonant frequency of the circuit 302*a* based on the characteristics of the capacitor C2.

Figure 14B:
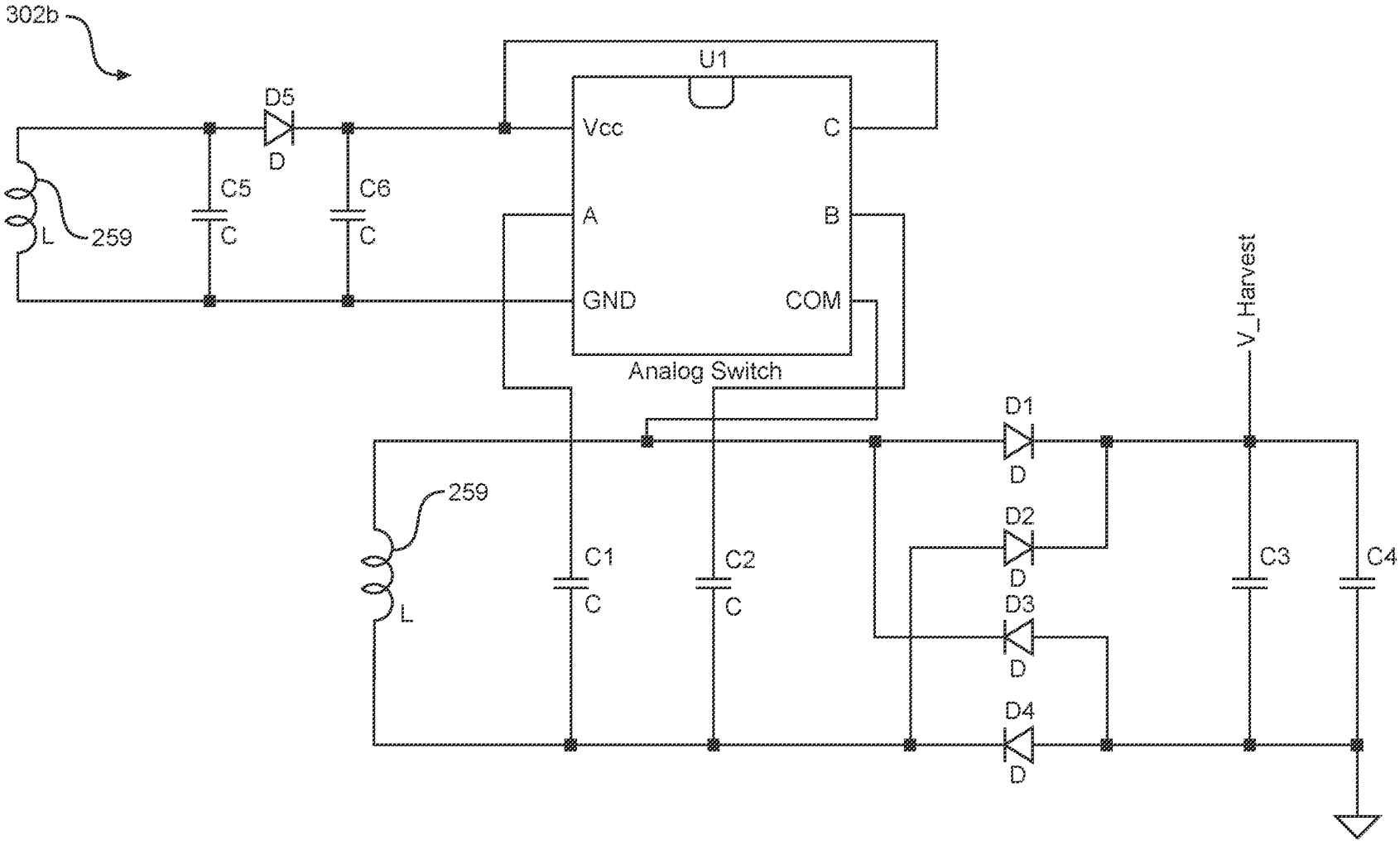
FIG. 14B is a diagram illustrating another embodiment of a resonant circuit of a light assembly according to an embodiment of the present disclosure.

Referring to FIG. 14B, in another embodiment the light assembly 15 can include a resonant circuit 302*b*. The resonant circuit 302*b* includes an integrated circuit U1, inductors 259, capacitors C1-C6, and diodes D1-D5. The inductor 259 and the capacitor C1 are arranged in parallel to form an LC circuit. The LC circuit is configured to store electrical energy when oscillating at its resonant frequency $f_1$. The diodes D1-D4 are arranged to form a full-wave rectifier. The full-wave rectifier may convert the input waveform received from the LC circuit to one of constant polarity that can be used to power an LED, as described herein. In the example of FIG. 14B, the circuit component formed by the inductor 259, the diode D5 and the capacitors C5 and C6 may detect that the resonant circuit 302*b* is operating at the frequency $f_0$, rather than the desired resonant frequency $f_1$. When this discrepancy is detected, output B of the integrated circuit U1 will be enabled. When output B of the integrated circuit U1 is enabled, the capacitor C2 will change the resonant frequency of the circuit based on the characteristics of the capacitor C2. In contrast, when the circuit is operating at the desired resonant frequency $f_1$, output A of the integrated circuit U1 will be enabled, thereby maintaining the resonant frequency $f_1$ of the circuit determined by L1 and C1.

Figure 14C:
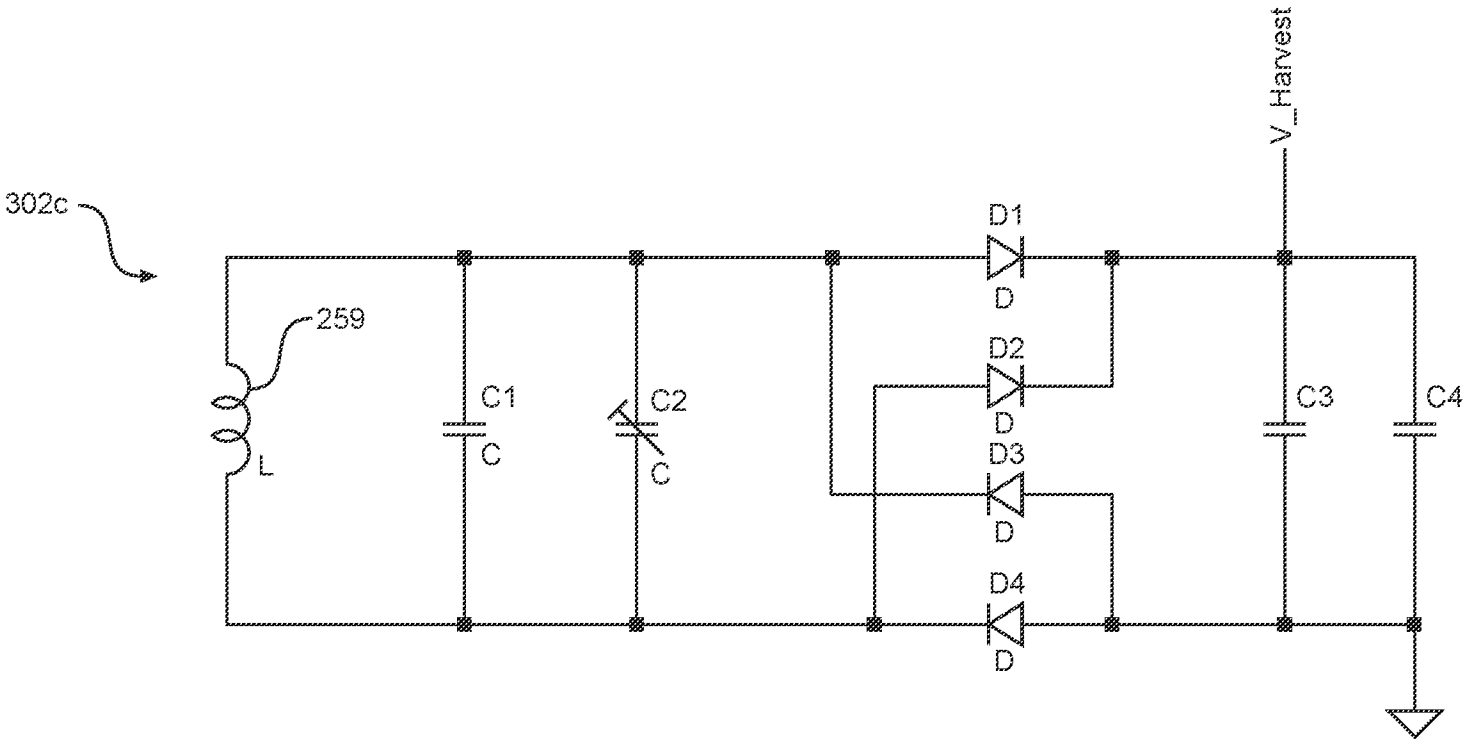
FIG. 14C is a diagram illustrating a further embodiment of a resonant circuit of a light assembly according to an embodiment of the present disclosure.

Referring to FIG. 14C, in another embodiment the light assembly 15 can include a resonant circuit 302*c*. The resonant circuit 302*c* includes an inductor 259, capacitors C1-C4 and diodes D1-D4. The inductor L and the capacitor C1 are arranged in parallel to form an LC circuit. The LC circuit is configured to store electrical energy when oscillating at its resonant frequency $f_1$. The diodes D1-D4 are arranged to form a full-wave rectifier. The full-wave rectifier may convert the input waveform received from the LC circuit to one of constant polarity that can be used to power an LED, as described herein. In the example of FIG. 14C, the capacitor C2 of the resonant circuit 302*c* is an adjustable capacitor. The resonant frequency $f_1$ of the circuit 302*c* may be altered by changing the capacitance value of capacitor C2.

The circuit 300 also includes the LED driver 318, which drives the LED 268. The LED driver 318 drives the LED 268 either through power received from the batteries 248, or power received from the resonant circuit 302. In one embodiment, the LED driver 318 can power the LED 268 with a different current depending on the source of the power. For example, the LED driver 318 can power the LED 268 at a first amperage when receiving power from the resonant circuit 302, and subsequently power the LED 268 at a second amperage different than the first amperage when receiving power from the batteries 248.

Operation of the Spray Gun and Light Assembly

In operation, a user will manually grip the handle 32 of the gun body 11 when the user intends to begin using the spray gun 10. When the user wants to begin using the spray gun 10, the user may actuate the spray gun 10 by manually actuating the actuator assembly 45, which may be a trigger assembly 50. Actuating the actuator assembly 45 directs the controller 72 to switch the coating material flow control valve 61 from a closed position to an open position. This allows coating material to flow from the coating material supply 60, through the coating material flow control valve 61, and through the supply hose to 64 to the spray gun 10. From there, the coating material flows along the coating material flow path 19, which extends from the handle 32, through the barrel 34, and to the nozzle assembly 36. The coating material then becomes charged by the electrode 100 before exiting the nozzle assembly 36. Simultaneous with the opening of the coating material flow control valve 61, the controller 72 may switch the valve 97 from a closed position to an open condition to enable pressurized air from the electrode wash air source 96 to flow through the air passageway 148. The air passageway 148 extends through the handle 32 of the spray gun 10, through the barrel 34, and to the nozzle assembly 36 so as to provide a flow of pressurized air across the electrode tip 100*a* to help prevent accumulation of coating material on the electrode tip 100*a*.

Additionally, when the user actuates the actuator assembly 45, the controller 72 may actuate the switch 94 from the illustrated open condition (FIG. 4) to the closed condition, which serves to connect the power source 93 with the voltage multiplier 140 through the electrical cable or connection 70 and the electrical input 170. This, in turn, switches the voltage multiplier 140 from a deactivated state to an activated state, such that the voltage multiplier 140 provides a charge to the electrode 100. When the voltage multiplier 140 is in the activated state, the transformer 160 included in the voltage multiplier 140 creates a magnetic field H. The magnetic field H induces a current in the inductor 259 of the inductor PCA 258, which provides power to the LED 268 as described above. As a result, the electrical energy obtained by the inductor 259 causes the LED 268 to be switched from an unlit state to a lit state when the actuator assembly 45 switches the voltage multiplier from the deactivated state to the activated state. The LED 268 allows the operator of the spray gun 10 to better inspect the work piece to which the coating material is being applied during operation of the spray gun 10 and ensure that the coating material is being applied in a satisfactory manner.

However, when the user no longer actuates the actuator assembly 45, the voltage multiplier 140 is switched from the activated state to the deactivated state, such that the transformer 160 ceases creating the magnetic field H. As a result, a current is no longer induced in the inductor 259 of the inductor PCA 258, and the resonant circuit 302 can no longer provide power to the LED 268. In this situation, the holdup time logic and pass MOSFET 310 detects the cessation of power from the resonant circuit 302, and directs the LED driver 318 to draw power from the boost converter 314, and thus the batteries 248. As such, the LED 268 can remain in the lit state for a period of time when the spray gun 10 is not in use so that the operator of the spray gun 10 can continue to inspect the work piece. This period of time, as described above, is controlled by the holdup time logic and pass MOSFET 310. After the period of time expires, the holdup time logic and pass MOSFET 310 prevents the LED 268 from further drawing power from the batteries 248. It should be noted that regardless of whether the LED 268 is being powered by the resonant circuit 302 or the batteries 248, the light assembly 15 is not electrically connected to any portion of the spray gun 10.

The ability of the LED 268 to remain in the lit state through drawing power from the batteries 248 after the voltage multiplier 140 has been switched to the deactivated state provides several benefits. First, time is saved, as the operator does not have to switch to a second tool to provide light when inspecting the work piece. This simplifies a coating operation, as fewer tools are required. Further, power is saved, as the light assembly 15 does not require an additional power source beyond the power source 93 used to power the spray gun 10 and the batteries 248 contained in the battery housing 200. The light assembly 15 described above can also be applied to existing spray guns lacking built in light sources, which lowers total coating costs by preventing the need to acquire additional coating tools.

Each particular light assembly 15 can define an optimal distance at which the light emitted by the LED 268 will illuminate the particular work piece, as well as a color that optimally contrasts with a particular coating material. This is typically dictated by the characteristics of the lens 264 attached to the lens housing 260. However, given the different types and sizes of work pieces and the varieties of coating materials that spray guns 10 can be utilized with, a particular light assembly 15 will not be optimal for use in every coating application. For example, in one coating operation the work piece can be situated 8-10 inches from the spray gun 10, but in another coating operation the work piece can be situated further from the spray gun 10. As a result, the light assembly 15 can be configured such that the lens 264 and/or lens cover 204 is releasably attached to the lens housing 260, such that an operator of the spray gun 10 can detach a particular lens 264 and/or lens cover 204 from the light assembly 15 when it becomes suboptimal for use with a particular coating operation, and attach a different lens 264 and/or lens cover 204 having preferred qualities. The lens 264 and lens cover 204 can be releasably attached to the lens housing 260 through a variety of means, such as bayonet style, threading, or snap fit engagement. Different lenses 264 and lens covers 204 can cause the light from the LED 268 to embody different colors, such as white, red, or green, which each provide an optimal contrast with different types and colors of coating materials. Though specific colors are listed, they are not meant to be exhaustive. Alternatively, a colored cap could be put on the lens cover 204 to produce the desired color of light. Further, different lenses 264 and/or lens covers 204 can increase or decrease the optimal distance at which the light from the LED 268 illuminates the work piece, also referred to as the focus (discussed further below) by either increasing or decreasing the departure angle of the light from the light assembly 15.

Spray Gun with Integral Light Assembly

With reference to FIGS. 15-19, another spray gun 10*a* according to the present disclosure will be described. The spray guns 10 and 10*a* comprise many of the same elements. As a result, any shared elements will be similarly numbered, but not described, in relation to spray gun 10*a*. Like the spray gun 10, the spray gun 10*a* includes gun body 11*a* and a light assembly 15*a* mounted to the gun body 11*a*. However, the light assembly 15*a* is integral with the gun body 11*a* of the spray gun 10*a*. Specifically, the light assembly 15*a* can include a housing 402 that is integral with a barrel 34*a* of the gun body 11*a*. The light assembly 15*a* includes a LED 400 that, like the LED 268, can be used to illuminate and inspect a work piece (not shown) to which the coating material from the spray gun 10*a* is applied. Though labeled as an LED, the LED 400 can alternatively be any other type of light, as desired. The light assembly 15*a* may further include a power supply 401, also referred to as an energy store, which provides power to the LED 400, and thus switches the light from an unlit state to a lit state. Additionally, the light assembly 15*a* may include a circuit 410 that controls the operation of the light assembly 15*a*. The circuit 410 may be a part of the power supply 401, and can include any of the components of the circuit 300 discussed above, such as the resonant circuits 302*a*-302*c*. Likewise, the circuit 300 can include any of the components of the circuit 410 as discussed below. The light assembly 15*a* is electrically isolated from the voltage multiplier 140, which prevents charge buildup that may cause damage to the internal parts of the spray gun 10*a*. The light assembly 15*a* is thermally efficient and prevents thermal hot spots from forming on the spray gun 10*a* during operation of the spray gun 10*a*. Thermal hot spots may cause coating material to cure to the interior and exterior of the gun body 11*a*, which negatively affect operation of the spray gun 10*a*. The light assembly 15*a* may include a lens and/or lens cover that focuses the light produced by the LED 400. For example, the light assembly 15*a* can include the lens 264 and/or lens cover 204 described in relation to light assembly 15.

Figure 18:
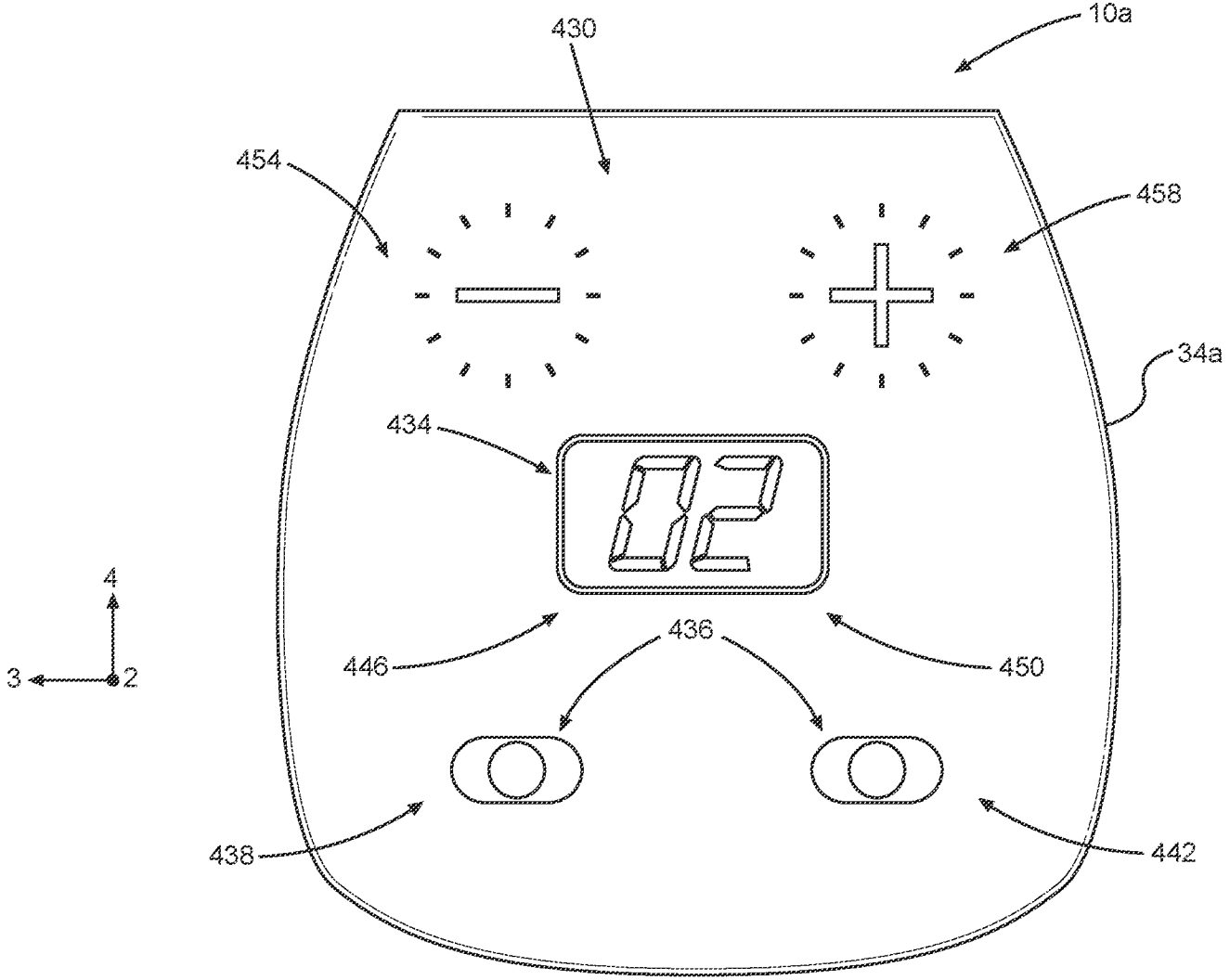
FIG. 18 is a simplified rear view of the barrel of the spray gun shown in FIG. 15.

Referring to FIG. 18, the spray gun 10*a* can also include a display 430 for presenting information to an operator concerning one or more operating parameters, as well as other information about the spray gun 10*a*. In the depicted embodiment, the display 430 is located on the rear end of the barrel 34*a* so as to be easily visible to an operator while the operator is using the spray gun 10*a*.

The display 430 can be attached to or recessed within the gun body 11*a*, and can include a visual indicator device 434 that includes a pair of segmented LEDs for displaying an operational value of the spray gun 10*a* or a related component. For example, the display 430 can include first and second LED displays 446, 450. Each of the first and second LED displays 446, 450 is depicted as including seven segmented LED displays. However, it is contemplated that the first and second LED displays 446, 450 can be configured otherwise, such as comprising LCD displays, etc. Further, in other embodiments the display 430 can include more than two or only one LED display as desired.

For changing the value of the parameter shown on the visual indicator device 434, the display 430 can include a first button 454 and a second button 458 spaced from the first button 454. As shown, the first button 454 is labeled with a minus sign, and can be used to decrease the value shown on the visual indicator device 434, while the second button 458 is labeled with a plus sign, and can be used to increase the value shown on the visual indicator device 434. By pressing and releasing the first button 454 or the second button 458, the value shown on the visual indicator device 434, and thus the corresponding value of the operating parameter of the spray gun 10*a*, can be respectively decreased or increased by one. By pressing and holding the first button 454 or the second button 458, the value shown on the visual indicator device 434, and thus the corresponding value of the operating parameter of the spray gun 10*a*, can be respectively decreased or increased until the first button 454 or the second button 458 is no longer held. In other embodiments, the first and second buttons 454, 458 can be replaced with a numerical keypad for manually inputting the desired value of the operating parameter represented on the visual indicator device 434.

The display 430 may also include one or more manually actuated inputs 436, which in the present embodiment are depicted as pushbutton membrane switches. In the depicted embodiment, the manually actuated inputs 436 includes a first input 438 and a second input 442. Each of the manually actuated inputs 436 can be used to alternate between various operational modes of the spray gun 10*a*, as well as between different operating parameters for display on the visual indicator device 434 and control with the first and second buttons 454, 458. These operational parameters can include the brightness level, focus level, time mode, color temperature, etc., as will be discussed further below. Though two manually actuated inputs 436 are depicted, the display 430 can alternatively include only one or more than two manually actuated inputs. Further, the manually actuated inputs 436 can alternatively be configured as dials, knobs, buttons, or any other type of input that can be manually actuated by an operator of the spray gun 10*a*.

Integral Light Assembly Electrical Components

Now referring to FIG. 19, the circuit 410 will be described. The inductor 259 can provide electrical energy to the circuit 410 through resonant circuit 302, which can be one of resonant circuits 302*a*-302*c*, as previously described. The circuit 410 may also include a full wave rectifier BR1 connected to the resonant circuit 302. The circuit 410 may include a voltage regulation circuit 500 that may be configured to manage the voltage distribution amongst the various component parts of the circuit 410, which will be described below. The circuit 410 may also include a holdup time control circuit 505, which is configured to control the amount of time that the LED 400 remains on after the voltage multiplier 140 is deactivated. The holdup time control circuit 505 may direct the LED 400 to switch from a lit state to an unlit state simultaneously when the voltage multiplier 140 switches from the activated state to the deactivated state, remain in the lit state for a set period of time after the voltage multiplier 140 has switched to the deactivated state, or remain on until the component of the circuit 410 that stores electrical energy from the inductor 259 loses energy. These aspects of the holdup time control circuit 505 may be preset, or may be manually changeable by a user of the spray gun 10*a* through some user interface (not shown).

The circuit 410 may also include a rechargeable battery 515 that is configured to power the LED 400, as well as store electrical energy received from the inductor 259. The rechargeable battery 515 may be removably integrated into the circuit 410 such that the rechargeable battery 515 may be replaced as needed. The electrical energy stored by the rechargeable battery 515 may be used to power the LED 400 when the voltage multiplier 140 is in the deactivated state. The rechargeable battery 515 may also include any number of rechargeable batteries as desired, such as two or three rechargeable batteries. The circuit 410 may include a battery charger circuit 510 that is configured to control charging of the rechargeable battery 515. In one embodiment, the battery charger circuit 510 is capable of sensing the level of energy of the rechargeable battery 515, and subsequently charging or not charging the rechargeable battery 515 based upon this sensed level of energy. When the circuit 410 includes more than one rechargeable battery 515, the circuit 410 may also include a corresponding number of battery charger circuits 510. For example, if the circuit 410 includes two rechargeable batteries 515, the circuit will also include two battery charger circuits 510, with each battery charger circuit 510 corresponding to a respective rechargeable battery 515. Likewise, if the circuit 410 includes three rechargeable batteries 515, the circuit will also include three battery charger circuits 510.

Alternatively, the circuit 410 may include capacitors to store energy received from the inductor 259, as well as power the LED 400 using the stored energy received from the inductor 259 when the voltage multiplier 140 is in the deactivated state. The circuit 410 may include capacitors in place of, or in combination with, the rechargeable battery 515.

Figure 19:
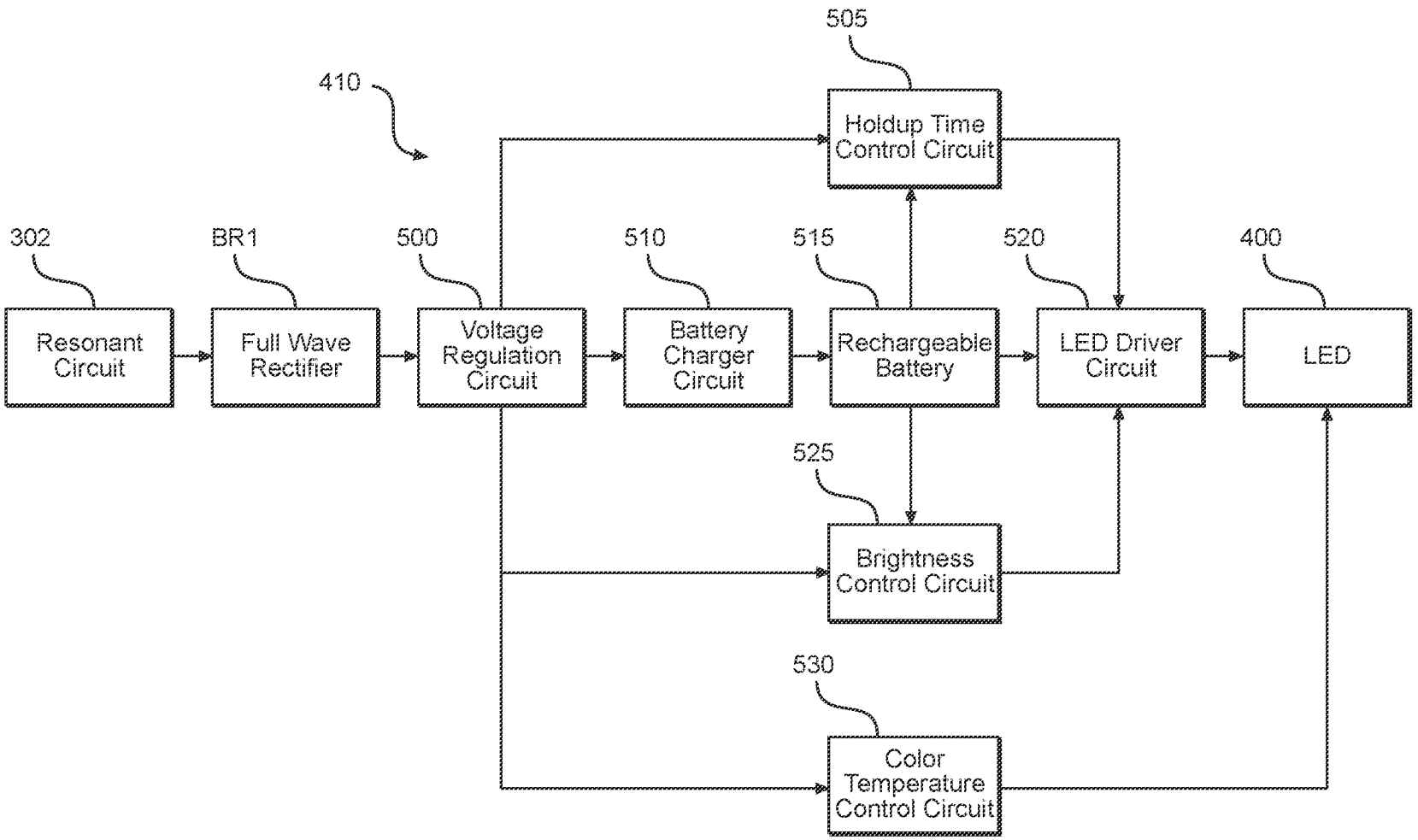
FIG. 19 is a schematic diagram of an embodiment of a second circuit included in a light assembly of the present disclosure.

With continued reference to FIG. 19, the circuit 410 may include a driver circuit 520 that is configured to control the voltage provided to the LED 400. The driver circuit 520 may be configured to receive inputs from the holdup time control circuit 505 and a brightness control circuit 525 to determine the amount of electrical energy to supply to the LED 400, as well as determine when to cut off and initiate power supply to the LED 400. The driver circuit 520 may receive electrical energy from the rechargeable battery 515 or the resonant circuits 302*a*-302*c*. The driver circuit 520 may also be configured to direct electrical energy to the LED 400 based upon actuation of a user input (not shown) by a user of the spray gun 10*a*. Additionally, the circuit 410 may include a brightness control circuit 525 that is configured to adjust the brightness level of the LED 400. A user of the spray gun 10*a* may desire to adjust the brightness level of the LED 400 based upon a particular application of the spray gun 10*a*, as will be discussed further below. Likewise, the circuit 410 may also include a color temperature control circuit 530 that is configured to adjust the Kelvin color temperature of the LED 400. Like the brightness level of the LED 400, a user of the spray gun 10*a* may desire to adjust the color temperature of the LED 400 based upon a particular application of the spray gun 10*a*.

Operation of the Spray Gun and Integral Light Assembly

In operation, a user will manually grip the handle 32 of the gun body 11*a* when the user intends to begin using the spray gun 10*a*. When the user wants to begin using the spray gun 10*a*, the user may actuate the spray gun 10*a* by manually actuating the actuator assembly 45, which may be the trigger assembly 50. Actuating the actuator assembly 45 directs the controller 72 to switch the coating material flow control valve 61 from a closed position to an open position. This allows coating material to flow from the coating material supply 60, through the coating material flow control valve 61, and through the supply hose to 64 to the spray gun 10*a*. From there, the coating material flows along the coating material flow path 19, which extends from the handle 32, through the barrel 34*a*, and to the nozzle assembly 36. The coating material then becomes charged by the electrode 100 before exiting the nozzle assembly 36. Simultaneous with the opening of the coating material flow control valve 61, the controller 72 may switch the valve 97 from a closed position to an open condition to enable pressurized air from the electrode wash air source 96 to flow through the air passageway 148. The air passageway 148 extends through the handle 32 of the spray gun 10*a*, through the barrel 34*a*, and to the nozzle assembly 36 so as to provide a flow of pressurized air across the nozzle 20 to help prevent accumulation of coating material at the electrode tip 100*a*.

Additionally, when the user actuates the actuator assembly 45, the controller 72 may actuate the switch 94 from the illustrated open condition (FIG. 4) to the closed condition, which serves to connect the power source 93 with the voltage multiplier 140 through the electrical cable or connection 70 and the electrical input 170. This, in turn, switches the voltage multiplier 140 from a deactivated state to an activated state, such that the voltage multiplier 140 provides a charge to the electrode 100. When the voltage multiplier 140 is in the activated state, the transformer 160 included in the voltage multiplier 140 creates a magnetic field H. The inductor 259 in the power supply 401, particularly the circuit 410, obtains electrical energy from the magnetic field H, which is capable of powering the LED 400. The electrical energy obtained by the inductor 259 is capable of charging a means for storing the electrical energy via the circuit 410. The means for storing the electrical energy may include other capacitors, the rechargeable battery 515, or a combination thereof.

Due to the electrical energy obtained by the inductor 259 in the power supply 401, the power supply 401 is capable of switching the LED 400 from an unlit state to a lit state when the actuator assembly 45 switches the voltage multiplier 140 from the deactivated state to the activated state. The LED 400 allows the user of the spray gun 10*a* to better inspect the work piece to which the coating material is being applied during operation of the spray gun 10*a* and ensure that the coating material is being applied in a satisfactory manner. Additionally, the capacitors and/or the rechargeable battery 515 can provide the LED 400 with stored electrical energy after the voltage multiplier 140 has been switched from the activated state to the deactivated state. As a result, the user can continue inspection of the work piece after the coating operation has been completed to ensure coating quality. The ability of the LED 400 to remain in the lit state through stored electrical energy after the voltage multiplier 140 has been switched to the deactivated state provides several benefits. First, time is saved, as the operator does not have switch to a second tool to provide light when inspecting the work piece. Also, this simplifies a coating operation, as fewer tools are required. Further, power is saved, as the light assembly 15*a* does not require an additional power source beyond the power source 93 used to power the spray gun 10*a*. However, in one embodiment, the light assembly 15*a* may also include a wired connection that connects the power supply 401 to an external power source (not shown) as a backup to the power supply 401. The external power source may be used in a situation when the power source 93 is deactivated and the power supply 401 no longer carries energy.

When the power supply 401 includes more than one rechargeable battery 515, the battery charger circuit 510 may control how the rechargeable batteries 515 are charged. In one embodiment, the power supply 401 can include first and second rechargeable batteries 515 and first and second battery charger circuits 510 that correspond to the first and second rechargeable batteries 515, respectively. As described above, when the voltage multiplier 140 is in the activated state, the inductor 259 in the circuit 410 obtains electrical energy from the magnetic field H. As a result, the circuit 410 may charge the first and second rechargeable batteries 515 through the first and second battery charger circuits 510. The first and second battery charger circuits 510 may be configured to monitor the energy level of each respective battery, and subsequently determine when the first and second rechargeable batteries 515 have reached a full charge. When the first and second rechargeable batteries 515 have reached a full charge, the first and second battery charger circuits 510 may direct the circuit 410 to cease charging the first and second rechargeable batteries 515 and rather use the electrical energy to power the LED 400. During the course of operating the spray gun 10*a*, a situation may arise where one of the first and second rechargeable batteries 515 charges faster than the other. In this situation, the one of the first and second battery charger circuits 510 that corresponds to the rechargeable battery 515 that has charged first will detect the full charge, and will direct the circuit 410 to only charge the other one of the first and second rechargeable batteries 515 that has not been fully charged yet, as well as only power the LED 400 using the rechargeable battery 515 that has fully charged. Also, during the course of operating the spray gun 10*a*, a situation may arise where one of the first and second rechargeable batteries 515 has a low charge, while the other rechargeable battery 515 has a higher charge. In this situation, the one of the first and second battery charger circuits 510 that corresponds to the rechargeable battery 515 with the low charge will detect the low charge, and will direct the circuit 410 to only charge the one of the first and second rechargeable batteries 515 with the low charge, as well as only power the LED 400 using the rechargeable battery 515 that has the higher charge.

The light assembly 15*a* may be operated in several time modes. Each time mode corresponds to a period of time that the LED 400 remains in the lit state after the voltage multiplier 140 switches from the activated state to the deactivated state. The time mode employed by the spray gun 10*a* at any given time may be controlled and adjusted via the holdup time control circuit 505. The controller 72 of the spray gun 10*a* may change the time mode by adjusting a user input (not shown) connected to the holdup time control circuit 505, or by programming the holdup time control circuit 505 before initiating use of the spray gun 10*a*. In a first time mode, when the actuator assembly 45 switches the voltage multiplier 140 from the activated state to the deactivated state, the power supply 401 switches the LED 400 from the lit state to the unlit state. In this time mode, the electrical energy stored in the power supply 401 is not employed after the voltage multiplier 140 is switched to the deactivated state. In a second time mode, the power supply 401 is configured to maintain the LED 400 in the lit state for a fixed period of time following the actuator assembly 45 switching the voltage multiplier 140 from the activated state to the deactivated state. This time mode employs the electrical energy stored in the capacitors and/or the rechargeable battery 515 to power the LED 400 for a fixed period of time after the voltage multiplier 140 has been switched to the deactivated state. This fixed period of time can be preprogrammed into the holdup time control circuit 505, or selected by the user of the spray gun 10*a* and inputted into the holdup time control circuit 505 using a user input (not shown). The fixed period of time can be determined by the operator during operation of the spray gun 10*a*, or may be predetermined based upon the coating operation being performed or the work piece being inspected. In a third time mode, the power supply 401 is configured to maintain the LED 400 in the lit state following the actuator assembly 45 switching the voltage multiplier 140 from the activated state to the deactivated state for a variable period of time that corresponds to the time until the electrical energy stored in the power supply 401 is completely depleted. When the electrical energy stored in the power supply 401 is completely depleted, the LED 400 will switch from the lit state to the unlit state. Alternatively, the LED 400 will then transition to drawing electrical energy from an external power source connected to the power supply 401 via a wired connection. As such, the variable period of time that the LED 400 remains in the lit state in the third time mode is not constant, as it will depend upon such factors as the capabilities and characteristics of the particular power supply 401, how long the capacitors and/or the rechargeable battery 515 have had to charge before the voltage multiplier 140 was switched to the deactivated state, and the initial energy of the capacitors and/or the rechargeable battery 515 upon initially switching the voltage multiplier 140 to the activated state.

The light assembly 15*a* may also be operated in different color temperature modes. Color temperature relates to the color characteristics of light, and can be quantified as a numerical value measured in degrees Kelvin (K) on a scale from 1,000 K to 10,000 K. For example, lights having a color temperature from about 2,000 K to about 3,000 K may be referred to as "warm white" lights and may have an orange or yellow appearance, lights having a color temperature from about 3,000 K to about 4,500 K may be referred to as "cool white" lights and may have a neutral white or slight bluish appearance, and lights having a color temperature from about 4,600 K to about 6,500 K may be referred to as "daylight" lights and may have a blue and white appearance that replicates daylight. When using the spray gun 10*a*, different types of light with varying color temperatures may be required in different scenarios. Factors that may affect the desired color temperature of light include the ambient light sources that exist, the type of coating material being used, and the type of work piece to which the coating material is being applied. The spray gun 10*a* may include the color temperature control circuit 530 to control the color temperature of the LED 400. Likewise, the LED 400 may be a type of light that allows for variable color temperature. The user of the spray gun 10*a* may change the color temperature of the LED 400 by adjusting a user input (not shown) connected to the color temperature control circuit 530, or by programming the color temperature control circuit 530 before initiating use of the spray gun 10*a*. The color temperature of the LED 400 may be configured to be any level as desired. For example, in one embodiment the color temperature of the LED 400 may be from about 2,700 K to about 3,400 K. In another embodiment, the color temperature of the LED 400 may be from about 4,000 K to about 6,000 K.

The light assembly 15*a* can further be operated in different focus modes. During operation of the spray gun 10*a*, the light assembly 15*a* can be used to inspect work pieces of various sizes or distances from the spray gun 10*a*. As a result, the beam width of light emitted by the light assembly 15*a* can be broadened or narrowed, such as from a first beam width to a second beam width that is different than the first beam width, in order to provide an optimal level of focus for use with a particular work piece or powder type. In one embodiment, this can be accomplished by replacing a first lens of the light assembly 15*a*, which can be lens 264, as described above in connection with light assembly 15, with a different lens. However, other means for changing the focus mode of the light assembly 15*a* are contemplated.

In addition to the time and color temperature modes, the light assembly 15*a* may also be operated in several brightness modes, with each brightness mode corresponding to a different level of brightness of the LED 400. The brightness of the LED 400 may be altered for a variety of reasons, including the level of ambient light that exists in the environment the spray gun 10*a* is being used in, the type of coating material being applied, the type of work piece to which the coating material is being applied, and the eyesight quality of the user of the spray gun 10*a*. Additionally, lower brightness levels of the LED 400 may be used when the user of the spray gun 10*a* desires to save power and/or wants the light to remain in the lit state for a longer period of time. The brightness mode of the light assembly 15*a* can be changed using a user input (not shown) that is connected to the brightness control circuit 525. Alternatively, the brightness mode can be changed by actuating the actuator assembly 45 in different ways. For example, when the voltage multiplier 140 is in the activated state, a first actuation of the actuator assembly 45 may be configured to switch the voltage multiplier 140 to the deactivated state, and the power supply 401 may be configured to maintain the LED 400 at a first brightness level in the lit state. The first brightness level may define a first brightness mode. Alternatively, when the voltage multiplier 140 is in the activated state, a second actuation of the actuator assembly 45 may be configured to switch the voltage multiplier 140 to the deactivated state, and the power supply 401 may be configured to maintain the LED 400 at a second brightness level in the lit state. The second brightness level may define a second brightness mode. The second brightness level may be less than the first brightness level, or alternatively may be greater than the first brightness level. Alternatively, when the voltage multiplier 140 is in the activated state, a third actuation of the actuator assembly 45 is configured to switch the voltage multiplier 140 to the deactivated state, and the power supply 401 is configured to maintain the LED 400 at a third brightness level in the lit state. The third brightness level may define a third brightness mode. The third brightness level may be less than either or both of the first and second brightness levels, or the third brightness level may be greater than either or both of the first and second brightness levels. The light assembly 15*a* can include less or additional brightness modes as desired. Additionally, the method of choosing between brightness modes can employ user inputs other than the actuator assembly 45, and methods of using the actuator assembly 45 to choose between brightness modes other than those listed above can be used.

Though specifically described above in relation to changing the brightness mode, various other properties of the operation of the LED 400 can be changed by actuating the actuator assembly 45 in different ways. For example, the time mode, focus mode, and/or the color temperature of the LED 400 can be changed by actuating the actuator assembly 45 in different ways. In one embodiment, the first, second, and third actuations of the actuator assembly 45 as previously mentioned can refer to a single actuation of the actuator assembly 45, a quick double actuation of the actuator assembly 45 (i.e., the actuator assembly 45 is actuated twice in rapid succession), and a quick triple actuation of the actuator assembly 45 (i.e., the actuator assembly 45 is actuated three times in rapid succession), respectively. Additionally, the brightness mode, time mode, focus mode, and/or the color temperature of the LED 400 can be changed by means other than the actuator assembly 45, such as through actuating the manually actuated inputs 436, including the first and second switches 438, 442, as well as the first and second buttons 454, 458 of the display 430 as described above. As such, the components of the display 430 can be used to increase and decrease, as well as alternate between the brightness level, time mode, focus mode, and/or color temperature of the LED 400.

In operation, the spacing and orientation of the inductor 259 relative to the transformer 160 is a large factor in increasing the efficiency with which the inductor 259 obtains energy from the magnetic field H. In particular, the inductor 259 obtains more electrical energy from the magnetic field H when the transformer 160 and the inductor 259 are spaced closely together. Additionally, the magnetic field H induces a higher energy transfer in the inductor 259 when the transformer 160 and the inductor 259 are oriented either perpendicularly or parallel to each other. As a result, in one embodiment, the transformer 160 and the inductor 259 may be radially aligned relative to the longitudinal direction 2, such that a radius extending from within the gun body 11*a* in a direction that is perpendicular to the longitudinal direction 2 passes through both the transformer 160 and the inductor 259. This ensures that the transformer 160, which is disposed within the gun body 11*a*, and the inductor 259, which is disposed in the light assembly 15*a*, are spatially as close together as possible. Also, the first central axis $A_1$ of the transformer 160 and the second central axis $A_2$ of the inductor 259 may both be parallel to the longitudinal direction 2. In this embodiment, the first central axis $A_1$ and the second central axis $A_2$ are parallel to each other, such that the transformer 160 and the inductor 259 are oriented parallel with respect to each other. In another embodiment, the first central axis $A_1$ of the transformer 160 may be parallel to the longitudinal direction 2, while the second central axis $a_2$ of the inductor 259 may be perpendicular to the longitudinal direction 2. In this embodiment, the first central axis $A_1$ and the second central axis $A_2$ are perpendicular to each other, such that the transformer 160 and the inductor 259 are oriented perpendicular with respect to each other. In another embodiment, the first central axis $A_1$ of the transformer 160 may be perpendicular to the longitudinal direction 2, while the second central axis $A_2$ of the inductor 259 may be parallel to the longitudinal direction. In this embodiment, the first central axis $A_1$ and the second central axis $A_2$ are perpendicular to each other, such that the transformer 160 and the inductor 259 are oriented perpendicular with respect to each other.

Figure 15:
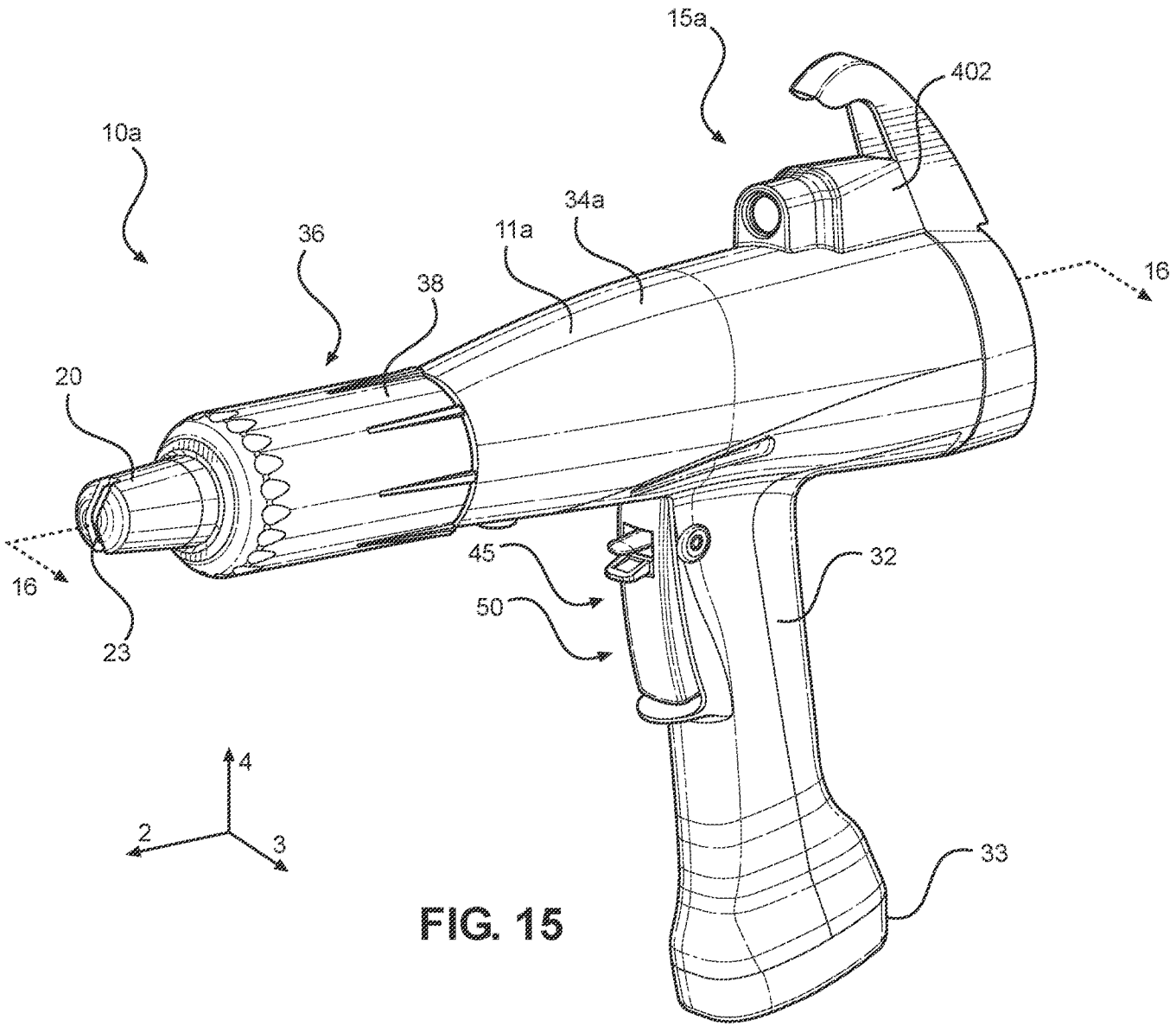
FIG. 15 is a perspective view of another spray gun according to an embodiment of the present disclosure with a light assembly attached.
Figure 16:
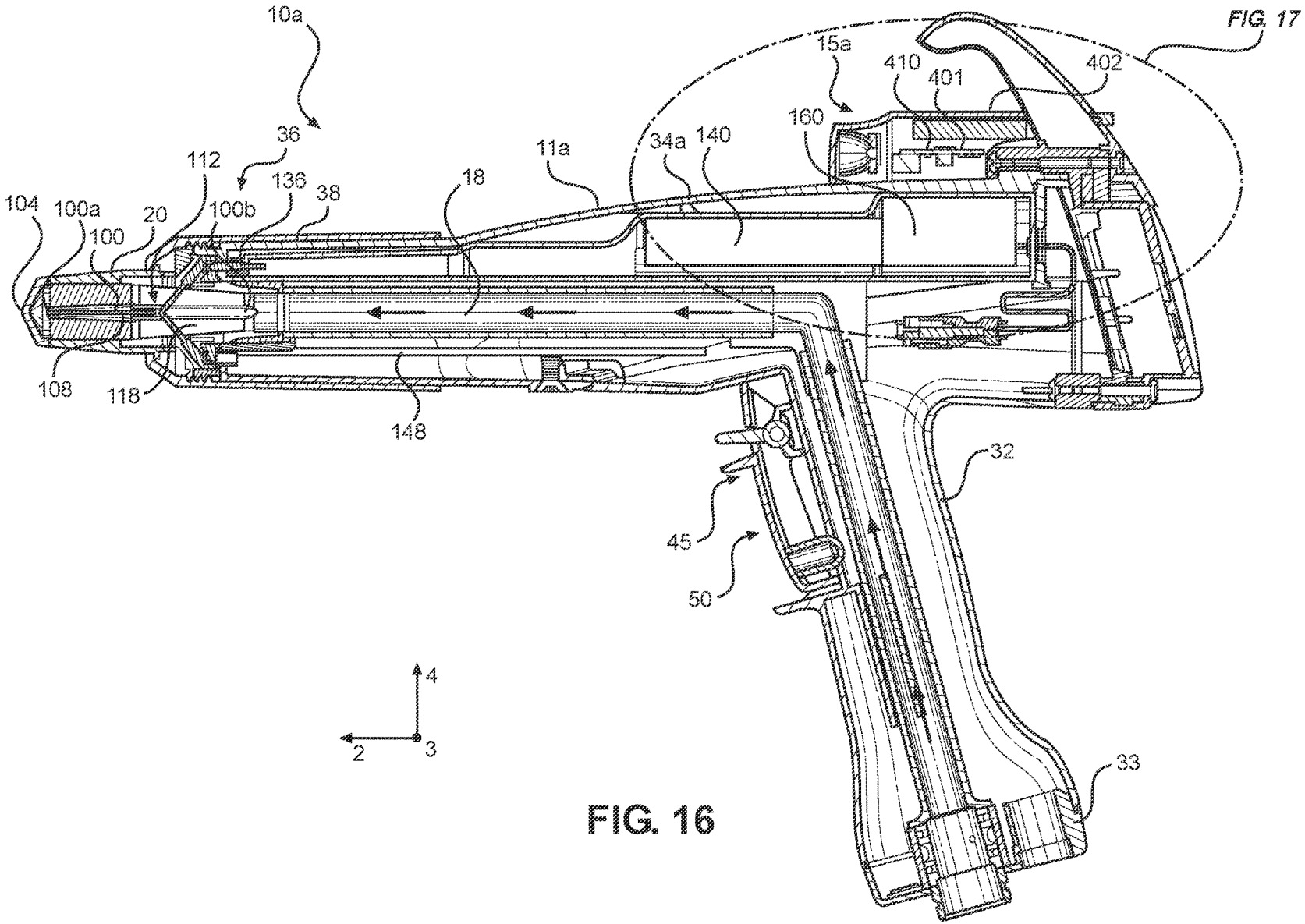
FIG. 16 is a cross-sectional view of the spray gun and light assembly shown in FIG. 15, taken along line 16-16 shown in FIG. 15.
Figure 17:
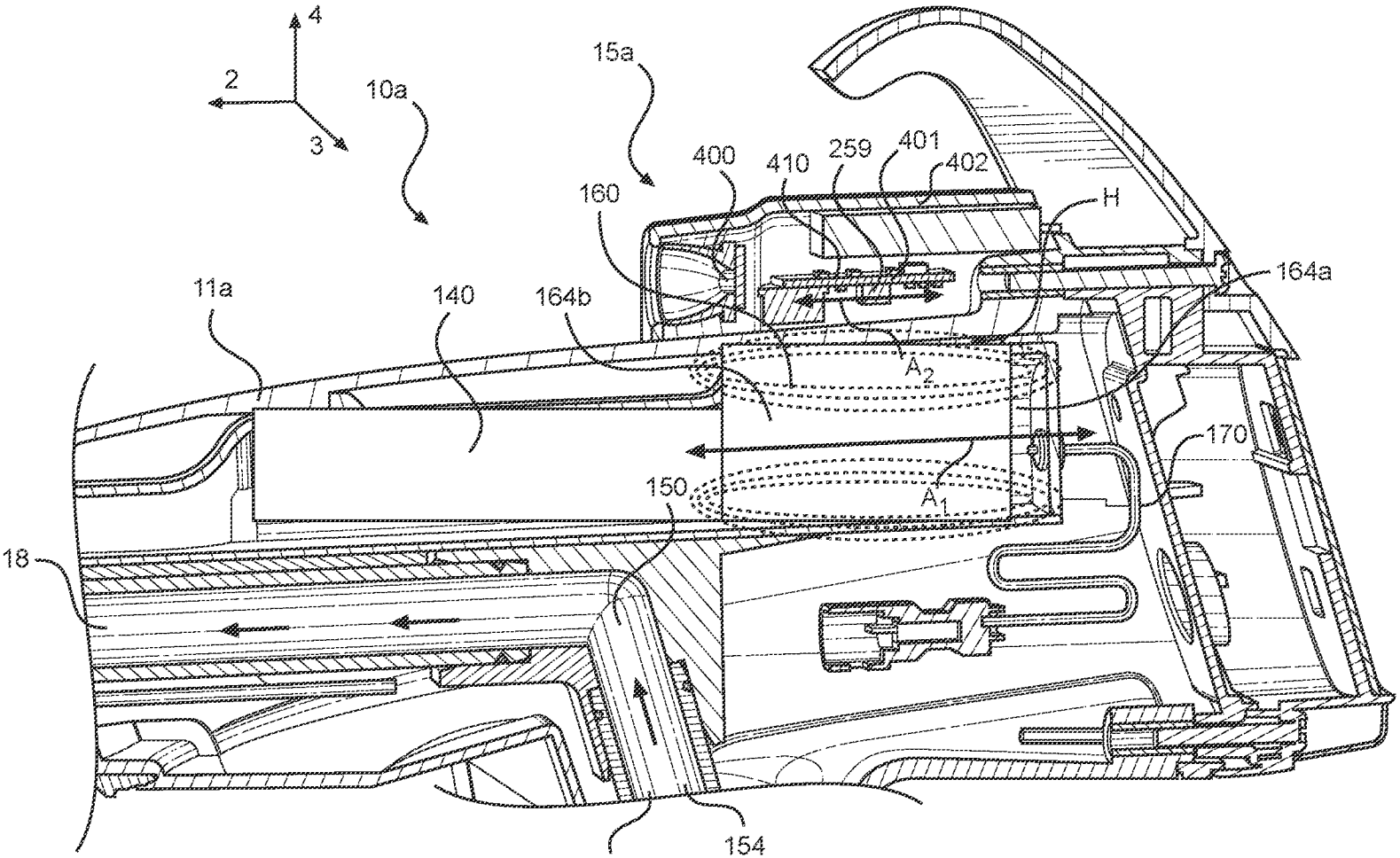
FIG. 17 is a cross-sectional view of a rearward portion of the spray gun shown in FIG. 15, noted by the encircled region in FIG. 16.

The light assembly 15*a* may also be configured such that the LED 400 may be spatially separated from the power supply 401 and the circuit 410. In one embodiment, as shown in FIGS. 15 and 16, the power supply 401 and the LED 400 may both be positioned near the transformer 160 near the rear of the barrel 34*a* of the spray gun 10*a*. In this embodiment, the placement of the whole light assembly 15*a* near the rear of the barrel 34*a* of the spray gun 10*a* keeps the center of gravity of the spray gun 10*a* from being affected, thus ensuring the spray gun 10*a* is balanced when held by the user. In another embodiment, the power supply 401 may be positioned near the transformer 160 near the rear of the barrel 34*a* of the spray gun 10*a*, while the LED 400 is positioned near the forward part of the barrel 34*a* of the spray gun. In particular, the LED 400 may be able to be positioned anywhere along the gun body 11*a*, including anywhere along the nozzle assembly 36, the barrel 34*a*, or the handle 32 as needed by the user of the spray gun 10*a* depending on the particular use of the spray gun 10*a* at a given time.

Light Assembly with Retrofit Attachment

Figure 20:
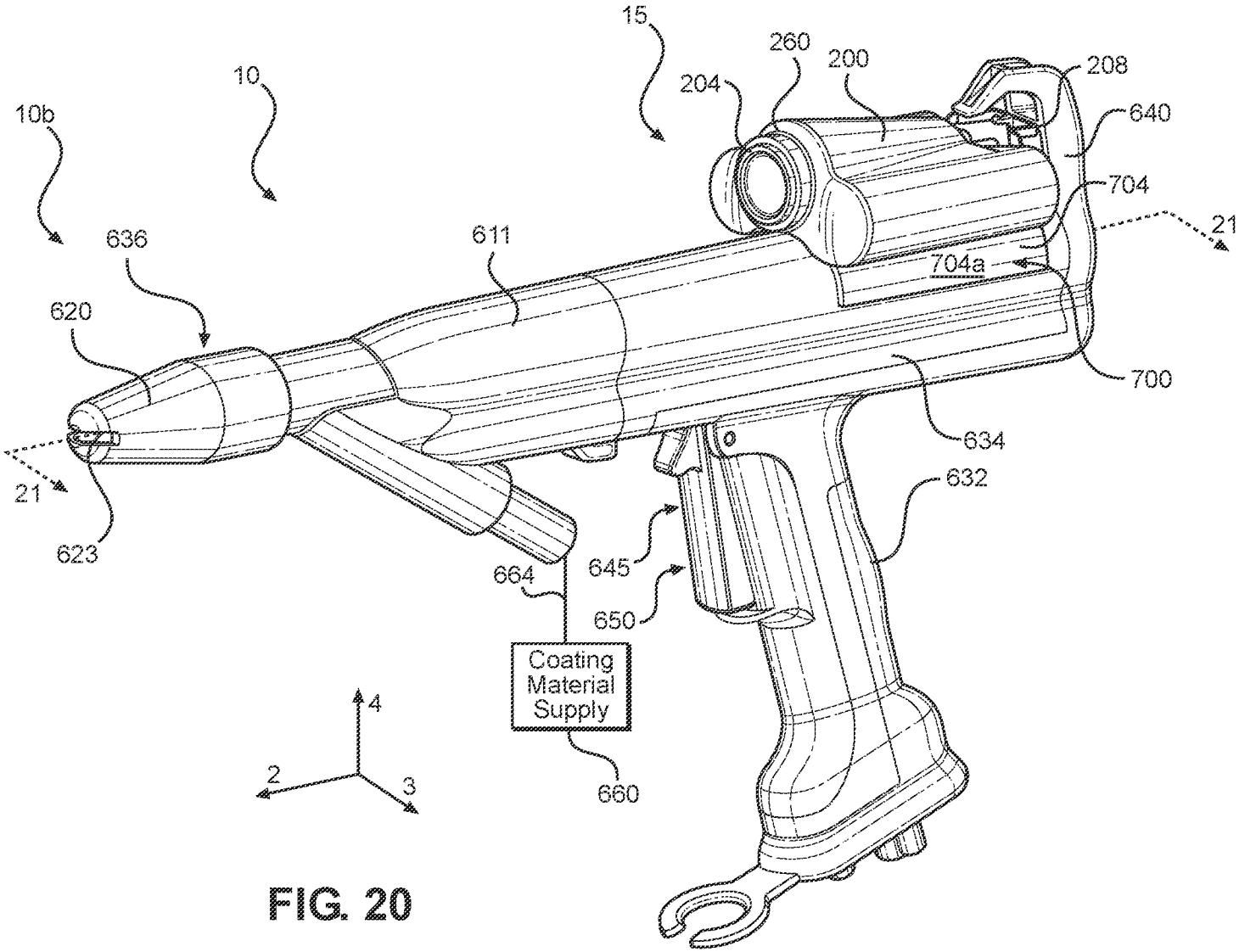
FIG. 20 is a perspective view of another spray gun according to an embodiment of the present disclosure with a light assembly attached.
Figure 21:
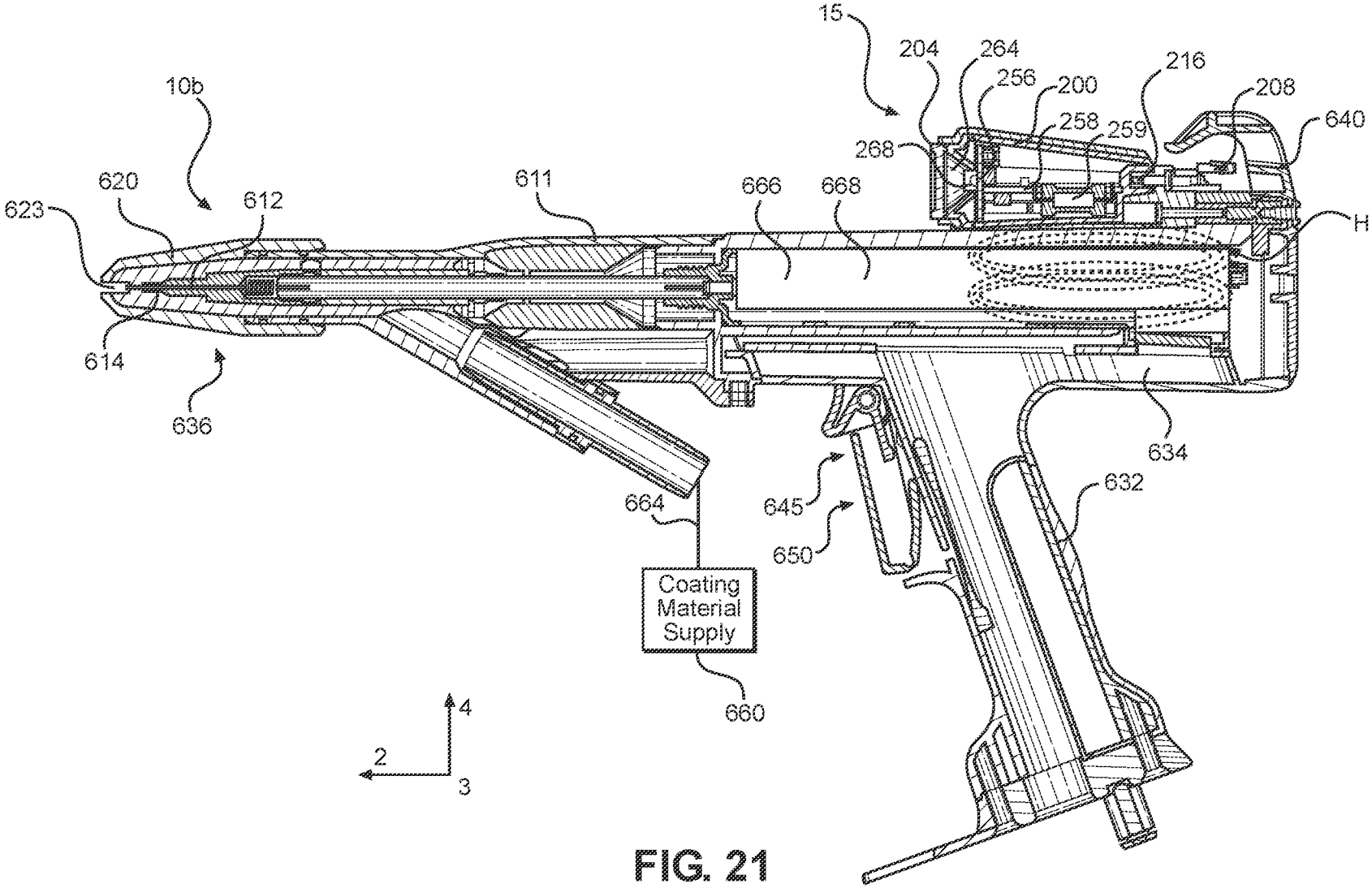
FIG. 21 is a cross-sectional view of the spray gun and light assembly shown in FIG. 20, taken along line 21-21 shown in FIG. 20.
Figure 22:
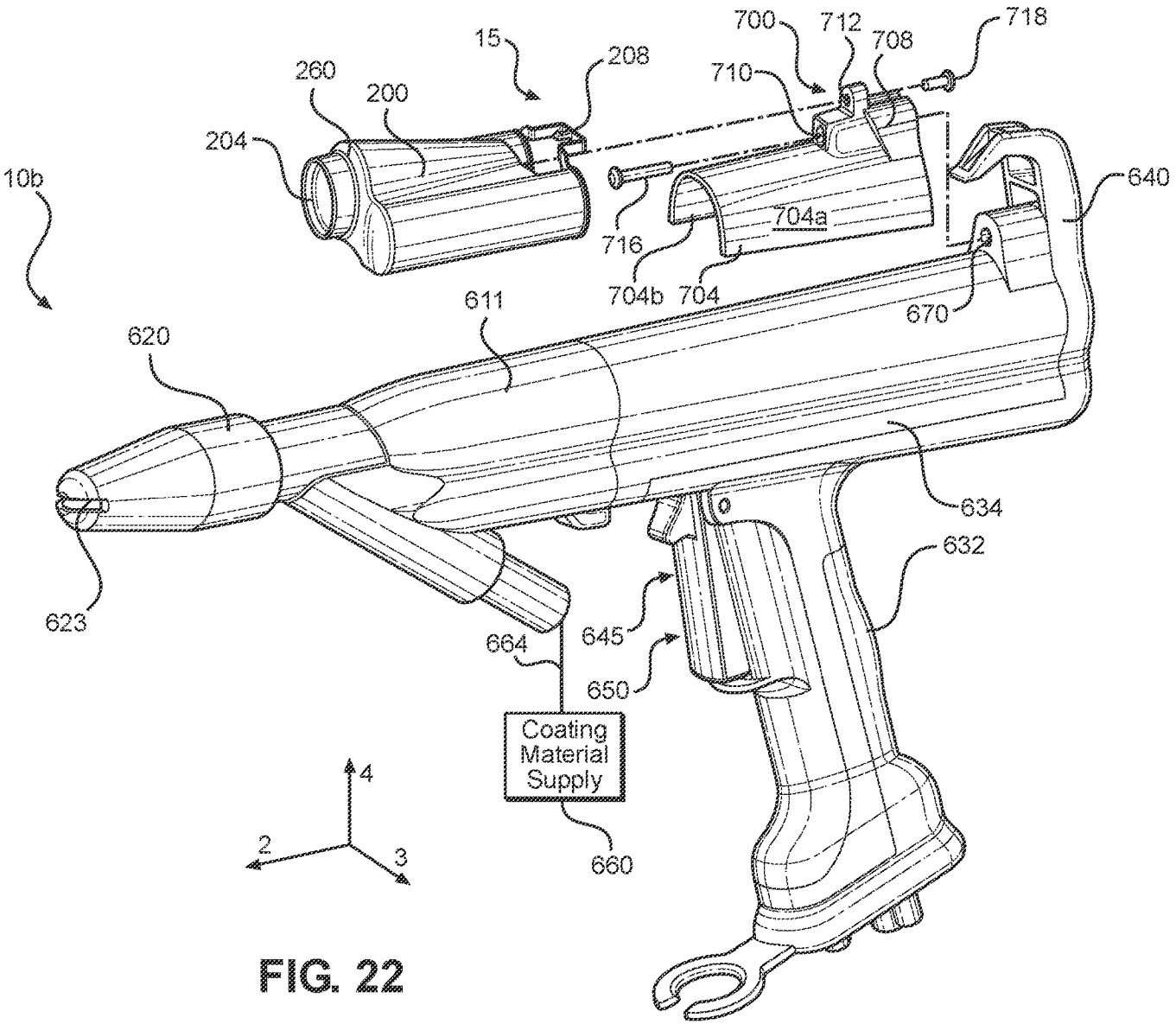
FIG. 22 is an exploded view of the spray gun and light assembly shown in FIG. 20.

Continuing with FIGS. 20-22, a system for connecting the light assembly 15 to another embodiment of a spray gun 10*b* is shown. The spray gun 10*b* can include a gun body 611, which may define a barrel 634, a nozzle assembly 636 that extends from the barrel 634 along the longitudinal direction 2, and a handle 632. The spray gun 10*b* can be manually operated. The barrel 634 of the spray gun 10*b* can include an applicator hook 640 extending upwardly from the top of the barrel 634. The light assembly 15 can be releasably attached to the barrel 634 forward of the applicator hook 640, as will be discussed further below. As shown, the handle 632 is configured to be manually gripped and may include a portion that contacts the user's hand and is grounded. The handle 632 can include an actuator assembly 645, such as trigger assembly 650, which allows a user to manually initiate and end operation of the spray gun 10*c*.

Unlike the spray guns 10, 10*a*, a coating material supply 660 can supply coating material to the spray gun 10*b* through a supply hose 664 that connects to the spray gun 10*b* at the forward end of the barrel 634, as opposed to through the handle 632. The supply hose 664 can transport the coating material to an outlet tube 18 that extends from the forward end of the barrel 634 to a nozzle 620 attached to the barrel 634. The nozzle 620 can include a slot 623 for spraying the coating material received from the outlet tube 18 out of the spray gun 10*b*. Though shown as a horizontal slot, it is contemplated that the slot 623 can define other shapes to produce different spray patterns.

Like the spray guns 10, 10*a*, the spray gun 10*b* can also include an electrode support assembly 612 disposed within the nozzle 20. The electrode support assembly 612 can support an electrode 614, which is configured to establish an electric field that charges the coating material as it exits the nozzle 620. The electrode 614 receives high voltage electrical energy from a voltage multiplier 666 that includes a transformer 668. When a user actuates the actuator assembly 645, the voltage multiplier 666 is transitioned from a deactivated state to an activated state, in which the voltage multiplier 666 supplies the high voltage electrical energy to the electrode 614. Additionally, in the activated state, the transformer 668 produces a magnetic field H, which can induce a current in the inductor 259 of the light assembly 15. The power harvesting aspects of the light assembly 15 are described at length above, and will not be repeated here for brevity.

Continuing with FIG. 22, the attachment of the light assembly 15 to the spray gun 10*b* using a retrofit attachment will be described in greater detail. In particular, the retrofit attachment can be a sleeve 700 used to attach the light assembly 15 to the spray gun 10*b*. The sleeve 700 provides a functionally flexible interface that advantageously allows the light assembly 15 to attach to a variety of types and designs of spray guns in addition to the spray gun 10*b* depicted. For example, the sleeve 700 can also be utilized to attach the light assembly 15 to the spray gun 10. The sleeve 700 can include a semi-circular shaped base 704 that has an upper surface 704*a* and a lower surface 704*b* opposite the upper surface 704*a*. The sleeve 700 can further include an extension 708 that extends from the upper surface 704*a* of the base 704. The extension 708 can include an upper bore 712 that extends longitudinally through the extension 708, as well as a lower bore 710 spaced downward from the upper bore 712 that also extends longitudinally through the extension 708. Each of the lower and upper bores 710, 712 can be threaded, such that the lower and upper bores 710, 712 are configured to receive first and second threaded screws 716, 718, respectively.

When the light assembly 15 is attached to the spray gun 10*b* with the sleeve 700, the sleeve 700 is in contact with the gun body 611. Specifically, the lower surface 704*b* of the base 704 is in contact with the barrel 634 of the spray gun 10*b*. The light assembly 15 contacts the upper surface 704*a* of the base 704, and can be positioned such that the thread insert 216 aligns with the upper bore 712 of the extension 708. The second screw 718 can be disposed through and engage the upper bore 712 and the thread insert 216 to couple the light assembly 15 to the spray gun 10*b*. The light assembly 15 and sleeve 700 can also be positioned such that the lower bore 710 of the extension 708 aligns with a bore 670 that extends into the barrel 634 of the spray gun 10*b*. The first screw 716 can be disposed through and engage the lower bore 710 and the bore 670 to attach the light assembly 15 and sleeve 700 to the spray gun 10*b*. Though the light assembly 15, sleeve 700, and spray gun 10*b* are described as attached through first and second screws 716, 718, other means of attachment are contemplated, such as snap fit, bayonet, etc.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts, and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features, and concepts may be expressly identified herein as being inventive or forming part of an invention, such identification is not intended to be exclusive, but rather there may be inventive aspects, concepts, and features that are fully described herein without being expressly identified as such or as part of a specific invention, the scope of the inventions instead being set forth in the appended claims or the claims of related or continuing applications. Descriptions of exemplary methods or processes are not limited to inclusion of all steps as being required in all cases, nor is the order that the steps are presented to be construed as required or necessary unless expressly so stated.

While the invention is described herein using a limited number of embodiments, these specific embodiments are not intended to limit the scope of the invention as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in a particular order as desired.

What is claimed is:

1. A manually held spray gun for spraying electrostatically charged coating material, the spray gun comprising:

a gun body comprising a barrel, a nozzle assembly extending from the barrel in a longitudinal direction, and a trigger assembly to control the spraying of the electrostatically charged coating material from the spray gun; and a light assembly coupled to the gun body, the light assembly including a light and circuitry electrically connected to the light, wherein the light assembly is configured to be selectively changed between 1) a first configuration in which the light assembly emits a light beam of a having a first color and 2) a second configuration in which the light assembly emits a light beam having a second color, different from the first color.

2. The manually held spray gun of claim 1, wherein the light assembly comprises:

a lens housing; and a lens configured to be releasably attached to the lens housing, wherein the lens is capable of being replaced by a different lens to adjust a color of light emitted from the light assembly.

3. The manually held spray gun of claim 1, comprising the different lens configured to be releasably attached to the lens housing, the different lens configured to cause light emitted from the light assembly to embody a different color than the lens.

4. The manually held spray gun of claim 1, wherein the light assembly comprises:

a lens housing; and a lens cover configured to be releasably attached to the lens housing, wherein the lens cover is capable of being replaced by a different lens cover to adjust a color of light emitted from the light assembly.

5. The manually held spray gun of claim 1, comprising the different lens cover configured to be releasably attached to the lens housing, the different lens cover configured to cause light emitted from the light assembly to embody a different color than the lens cover.

6. The manually held spray gun of claim 1, wherein the light assembly is configured to switch between the light and a different light so as to adjust a color of light emitted from the light assembly.

7. The manually held spray gun of claim 1, comprising the different light configured to cause light emitted from the light to embody a second color, different from the first color.

8. The manually held spray gun of claim 1, comprising:

a lens cover; and a cap configured to be releasably attached to the lens cover so as to be capable of being replaced by a different cap to adjust a color of light emitted from the light assembly.

9. The manually held spray gun of claim 1, comprising the different cap configured to be coupled to the light cover so as to cause light emitted from the light assembly to embody a second color, different from the first color.

10. The manually held spray gun of claim 1, wherein the light assembly is configured to emit a green light.

11. The manually held spray gun of claim 1, wherein the light assembly is configured to emit a red light.

12. The manually held spray gun of claim 1, wherein the electrical circuitry comprises a color temperature control circuit that is configured to adjust the color temperature of the light.

13. The manually held spray gun of claim 1, wherein the spray gun comprises a voltage multiplier.

14. The manually held spray gun of claim 9, wherein the voltage multiplier is transitionable between an activated state, in which the voltage multiplier produced a magnetic field, and a deactivated state, where the voltage multiplier does not produce the magnetic field.

15. The manually held spray gun of claim 9, wherein the electrical circuitry is configured to supply electric energy inductively obtained by the circuitry to the light when the voltage multiplier is in an activated state.

16. A method of operating the manually held spray gun of claim 1, comprising a step of changing between 1) a first configuration in which the light assembly emits a light beam of a having a first color and 2) a second configuration in which the light assembly emits a light beam having a second color, different from the first color.

17. The method of claim 16, wherein the changing step comprises selecting the second configuration based on one or more of existing ambient light sources, a type of coating material being used, and a type of work piece to which the coating material is being applied.

* * * * *